US010705466B2

(12) United States Patent
Kamei

(10) Patent No.: US 10,705,466 B2
(45) Date of Patent: Jul. 7, 2020

(54) IMAGE FORMING APPARATUS

(71) Applicant: CANON KABUSHIKI KAISHA, Tokyo (JP)

(72) Inventor: Yasuo Kamei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/562,240

(22) Filed: Sep. 5, 2019

(65) Prior Publication Data

US 2020/0081385 A1 Mar. 12, 2020

(30) Foreign Application Priority Data

Sep. 11, 2018 (JP) ..... 2018-169614

(51) Int. Cl.
*G03G 15/00* (2006.01)
*G03G 21/00* (2006.01)

(52) U.S. Cl.
CPC ..... *G03G 15/5062* (2013.01); *G03G 21/0005* (2013.01)

(58) Field of Classification Search
CPC ..... G03G 15/5041; G03G 15/5062; G03G 21/0005; G03G 21/20
USPC ..... 399/38, 46, 47, 51, 71, 107, 110, 118
See application file for complete search history.

(56) References Cited

U.S. PATENT DOCUMENTS 7,528,855 B2 * 5/2009 Namba ..... G03G 15/04072 347/241
8,112,012 B2 * 2/2012 Wong ..... H04N 1/00909 101/425

FOREIGN PATENT DOCUMENTS

JP 2016-31467 A 3/2016

* cited by examiner

*Primary Examiner* — Hoan H Tran
(74) *Attorney, Agent, or Firm* — Canon U.S.A., Inc. I.P. Division

(57) ABSTRACT

An image forming apparatus includes a photosensitive drum, an image forming unit including an optical scanning device, a cleaning mechanism configured to clean a transparent window of the optical scanning device, and a control unit configured to cause the cleaning mechanism to perform a cleaning operation on the transparent window. The number of pages on which image formation is allowed to be performed for recording sheets in a period between cleaning operations performed by the cleaning mechanism is smaller in a case where image formation is performed on recording sheets in which the amount of generation of paper dust is large than in a case where image formation is performed on recording sheets in which the amount of generation of paper dust is small.

19 Claims, 10 Drawing Sheets

FIG.10A

| SHEET SIZE | PAPER DUST | SIZE COEFFICIENT α1 |
|---|---|---|
| A3 (297 × 420 mm) | MUCH | 1.80 |
| A4 (297 × 210 mm) | MEDIUM | 1.00 |
| A5 (210 × 148 mm) | MEDIUM | 0.60 |
| A6 (148 × 105 mm) | A LITTLE | 0.50 |
| B4 (257 × 364 mm) | MEDIUM | 1.40 |
| B5 (257 × 182 mm) | MEDIUM | 0.80 |
| B6 (182 × 128 mm) | A LITTLE | 0.48 |

FIG.10B

| SHEET TYPE | GRAMMAGE t ($g/m^2$) | PAPER DUST | TYPE COEFFICIENT β1 |
|---|---|---|---|
| THIN PAPER | $52 \leq t < 60$ | A LITTLE | 0.50 |
| PLAIN PAPER | $60 \leq t < 106$ | MEDIUM | 1.00 |
| HEAVY PAPER | $106 \leq t < 221$ | MUCH | 1.70 |
| RECYCLED PAPER | $60 \leq t < 75$ | MUCH | 2.00 |
| PROCESSED PAPER | $91 \leq t < 105$ | AN EXTREMELY LITTLE | 0.35 |

IMAGE FORMING APPARATUS

BACKGROUND

Field

Aspects of the present disclosure generally relate to an image forming apparatus, such as a copying machine or a printer, which forms an image on a recording sheet with use of an electrophotographic method.

Description of the Related Art

A conventional image forming apparatus employing an electrophotographic method is equipped with an optical scanning device, which radiates laser light onto the surface of an electrically charged photosensitive member to form an electrostatic latent image on the photosensitive member. The optical scanning device includes optical system components, such as a light source and a mirror, a casing, which covers the optical system components, and an opening portion, through which light from the light source is output to outside the casing. Then, the opening portion is occluded by a transparent member, which allows light to pass therethrough, for the purpose of preventing a foreign substance such as toner or dust from intruding into the casing.

A recording sheet which is conveyed from a sheet feeding cassette or a sheet feeding tray to an image forming unit comes into contact with, for example, a conveyance roller during the process of being conveyed. Paper dust may be generated due to such a friction occurring at the time of conveyance of the recording sheet, and the generated paper duct may adhere onto the transparent member. In a case where a foreign substance, such as paper dust, toner, or mote, is present on the transparent member, light which is output through the opening portion is blocked by the foreign substance, so that a change in optical property occurs in the optical scanning device. As a result, the quality of an image which is formed on a recording sheet may decrease.

Therefore, for example, in an optical scanning device discussed in Japanese Patent Application Laid-Open No. 2016-31467, a cleaning member frictionally slides on a transparent member, thus removing a foreign substance adhering to the transparent member. Such a cleaning operation is performed each time the number of sheets used for printing reaches a predetermined number (for example, 10,000). In this way, the transparent member is periodically cleaned by such a cleaning mechanism.

There are various types and sizes of recording sheets. The amount of generation of paper dust caused by a friction occurring at the time of conveyance varies depending on types of recording sheets, such as the presence or absence of a coating on the recording sheet surface or the proportion of wood pulp or waste paper pulp contained in the recording sheet. Moreover, the amount of generation of paper dust per page for recording sheets also varies depending on sizes of recording sheets. In a conventional optical scanning device, the number of pages for recording sheets which are used for image formation in a period between cleaning operations is the same between a case where image formation is performed on recording sheets in which the amount of generation of paper dust is large and a case where image formation is performed on recording sheets in which the amount of generation of paper dust is small. Therefore, in a case where image formation has continued being performed on recording sheets of types or sizes in which the amount of generation of paper dust per page tends to be large, in spite of paper dust currently adhering onto the transparent member, image formation may be performed on recording sheets without any cleaning operation being performed.

SUMMARY

According to an aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs the next cleaning operation on the transparent window, and wherein the allowable number of pages, in a case where image formation is performed on only recording sheets of a predetermined size and of greater than or equal to a predetermined grammage after the cleaning mechanism performs the cleaning operation, is smaller than the allowable number of pages in a case where image formation is performed on only recording sheets of the predetermined size and of less than the predetermined grammage after the cleaning mechanism performs the cleaning operation.

According to another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs a next cleaning operation on the transparent window, and wherein the allowable number of pages, in a case where image formation is performed on only recording sheets of a predetermined size and of a waste paper pulp content rate greater than or equal to a predetermined value after the cleaning mechanism performs the cleaning operation, is smaller than the allowable number of pages in a case where image formation is performed on only recording sheets of the predetermined size and of a waste paper pulp content rate less than the predetermined value after the cleaning mechanism performs the cleaning operation.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs the next cleaning operation for the transparent window, and wherein the allowable number of pages, in a case where image formation is performed on only recording sheets of a predetermined size and with no coating made on surfaces thereof after the cleaning mechanism performs the cleaning operation, is smaller than the allowable number of pages in a case where image formation is performed on only recording sheets of the predetermined size and with a coating made on surfaces thereof after the cleaning mechanism performs the cleaning operation.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs the next cleaning operation on the transparent window, and wherein the allowable number of pages, in a case where image formation is performed on only recording sheets of a predetermined type and a predetermined grammage and of greater than or equal to a predetermined size after the cleaning mechanism performs the cleaning operation, is smaller than the allowable number of pages in a case where image formation is performed on only recording sheets of the predetermined type and the predetermined grammage and of less than the predetermined size after the cleaning mechanism performs the cleaning operation.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, a counter configured to, so as to count a number of pages of image-formed on recording sheets until, after performing the cleaning operation, the cleaning mechanism performs a next cleaning operation for the transparent window, count a value obtained by multiplying a reference value determined for one page of each recording sheet by a coefficient set according to whether each recording sheet is of greater than or equal to a predetermined grammage or is of less than the predetermined grammage, every time image formation on one page of each recording sheet is ended, and a control unit configured to generate a signal for a cleaning instruction to cause the cleaning mechanism to clean the transparent window in response to the value counted by the counter reaching a predefined value, wherein a value of the coefficient set for recording sheets of greater than or equal to the predetermined grammage is larger than a value of the coefficient set for recording sheets of less than the predetermined grammage, and wherein, in a case where image formation is performed for only identical numbers of pages on recording sheets of greater than or equal to the predetermined grammage and recording sheets of less than the predetermined grammage, the value counted by the counter is larger in a case where image formation is performed on recording sheets of greater than or equal to the predetermined grammage than in a case where image formation is performed on recording sheets of less than the predetermined grammage.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, a counter configured to, so as to count a number of pages of image-formed on recording sheets until, after performing the cleaning operation, the cleaning mechanism performs a next cleaning operation on the transparent window, count a value obtained by multiplying a reference value determined for one page of each recording sheet by a coefficient set according to whether a waste paper pulp content rate of each recording sheet is greater than or equal to a predetermined value or is less than the predetermined value, every time image formation on one page of each recording sheet is ended, and a control unit configured to generate a signal for a cleaning instruction to cause the cleaning mechanism to clean the transparent window in response to the value counted by the counter reaching a predefined value, wherein a value of the coefficient set for recording sheets of a waste paper pulp content rate greater than or equal to the predetermined value is larger than a value of the coefficient set for recording sheets of a waste paper pulp content rate less than the predetermined value, and wherein, in a case where image formation is performed for only identical numbers of pages on recording sheets of a waste paper pulp content rate greater than or equal to the predetermined value and recording sheets of a waste paper pulp content rate less than the predetermined value, the value counted by the counter is larger in a case where image formation is performed on recording sheets of a waste paper pulp content rate greater than or equal to the predetermined value than in a case where image formation is performed on recording sheets of a waste paper pulp content rate less than the predetermined value.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, a counter configured to, so as to count a number of sheets of image-formed on recording sheets until, after performing the cleaning operation, the cleaning mechanism performs a next cleaning operation for the transparent window, count a value obtained by multiplying a reference value determined for one page of each recording sheet by a coefficient set according to whether each recording sheet is of a predetermined size and with a coating made on a surface thereof, every time image formation on one page of each recording sheet is ended, and a control unit configured to generate a signal for a cleaning instruction to cause the cleaning mechanism to clean the transparent window in response to the value counted by the counter reaching a predefined value, wherein a value of the coefficient set for recording sheets with no coating made on surfaces thereof is larger than a value of the coefficient set for recording sheets with a coating made on surfaces thereof, and wherein, in a case where image formation is performed for only identical numbers of pages on recording sheets with no coating made on surfaces thereof and recording sheets with a coating made on surfaces thereof, the value counted by the counter is larger in a case where image formation is performed on recording sheets with no coating made on surfaces thereof than in a case where image formation is performed on recording sheets with a coating made on surfaces thereof.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light with toner and transferring the image developed to the recording sheet, a cleaning mechanism configured to clean the transparent window, a counter configured to, so as to count a number of sheets of image-formed on recording sheets until, after performing the cleaning operation, the cleaning mechanism performs a next cleaning operation on the transparent window, count a value obtained by multiplying a reference value determined for one page of each recording sheet by a coefficient set according to whether each recording sheet is of a predetermined type and a predetermined grammage and of greater than or equal to a predetermined size or not, every time image formation on one page of each recording sheet is ended, and a control unit configured to generate a signal for a cleaning instruction to cause the cleaning mechanism to clean the transparent window in response to the value counted by the counter reaching a predefined value, wherein a value of the coefficient set for recording sheets of greater than or equal to the predetermined size is larger than a value of the coefficient set for recording sheets of less than the predetermined size, and wherein, in a case where image formation is performed for only identical numbers of pages on recording sheets of greater than or equal to the predetermined size and recording sheets of less than the predetermined size, the value counted by the counter is larger in a case where image formation is performed on recording sheets of greater than or equal to the predetermined size than in a case where image formation is performed on recording sheets of less than the predetermined size.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, a counter configured to, so as to count a number of pages of image-formed on recording sheets until, after performing the cleaning operation, the cleaning mechanism performs a next cleaning operation for the transparent window, count a value set according to whether each recording sheet is of greater than or equal to a predetermined grammage or is of less than the predetermined grammage, every time image formation on one page of each recording sheet is ended, and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets of greater than or equal to the predetermined grammage and recording sheets of less than the predetermined grammage, the value counted by the counter is larger in a case where image formation is performed on recording sheets of greater than or equal to the predetermined grammage than in a case where image formation is performed on recording sheets of less than the predetermined grammage.

According to yet another aspect of the present disclosure, an image forming apparatus includes a photosensitive drum, an image forming unit including an optical scanning device having a transparent window through which laser light for scanning the photosensitive drum, the image forming unit being and configured to form an image on a recording sheet by developing, with toner, an electrostatic latent image formed on the photosensitive drum scanned by the laser light and transferring the image developed with toner to the recording sheet, a cleaning mechanism configured to clean the transparent window, a counter configured to, so as to count a number of pages of image-formed on recording sheets until, after performing the cleaning operation, the cleaning mechanism performs a next cleaning operation for the transparent window, count a value set according to whether a waste paper pulp content rate of each recording sheet is greater than or equal to a predetermined value, every time image formation on one page of each recording sheet is ended, and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets of a waste paper pulp content rate greater than or equal to the predetermined value and recording sheets of a waste paper pulp content rate less than the predetermined value, the value counted by the counter is larger in a case where image formation is performed on recording sheets of a waste paper pulp content rate greater than or equal to the predetermined value than in a case where image formation is performed on recording sheets of a waste paper pulp content rate less than the predetermined value.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light with toner and transferring the image developed to the recording sheet, a cleaning mechanism configured to clean the transparent window, a counter configured to, so as to count a number of sheets of image-formed on recording sheets until, after performing the cleaning operation, the cleaning mechanism performs a next cleaning operation for the transparent window, count a value set according to whether each recording sheet is of a predetermined size and with a coating made on a surface thereof, every time image formation on one page of each recording sheet is ended, and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets with no coating made on surfaces thereof and recording sheets with a coating made on surfaces thereof, the value counted by the counter is larger in a case where image formation is performed on recording sheets with no coating made on surfaces thereof than in a case where image formation is performed on recording sheets with a coating made on surfaces thereof.

According to yet another aspect of the present disclosure, an image forming apparatus includes a photosensitive drum, an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet, a cleaning mechanism configured to clean the transparent window, a counter configured to, so as to count a number of sheets of image-formed on recording sheets until, after performing the cleaning operation, the cleaning mechanism performs a next cleaning operation for the transparent window, count a value set according to whether each recording sheet is of a predetermined type and a predetermined grammage and of greater than or equal to a predetermined size or not, every time image formation on one page of each recording sheet is ended, and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets of greater than or equal to the predetermined size and recording sheets of less than the predetermined size, the value counted by the counter is larger in a case where image formation is performed on recording sheets of greater than or equal to the predetermined size than in a case where image formation is performed on recording sheets of less than the predetermined size.

Further features of the present disclosure will become apparent from the following description of exemplary embodiments with reference to the attached drawings.

BRIEF DESCRIPTION OF THE DRAWINGS

FIGS. 10A and 10B are diagrams illustrating coefficients corresponding to sheet sizes and sheet types in the first exemplary embodiment.

DESCRIPTION OF THE EMBODIMENTS

Various exemplary embodiments, features, and aspects of the disclosure will be described in detail below with reference to the drawings. Furthermore, for example, the dimension, material, shape, and relative location of each constituent component described in the following description are, unless specifically described, not intended to limit the scope of the disclosure only thereto.

<Image Forming Apparatus>

Figure 1:
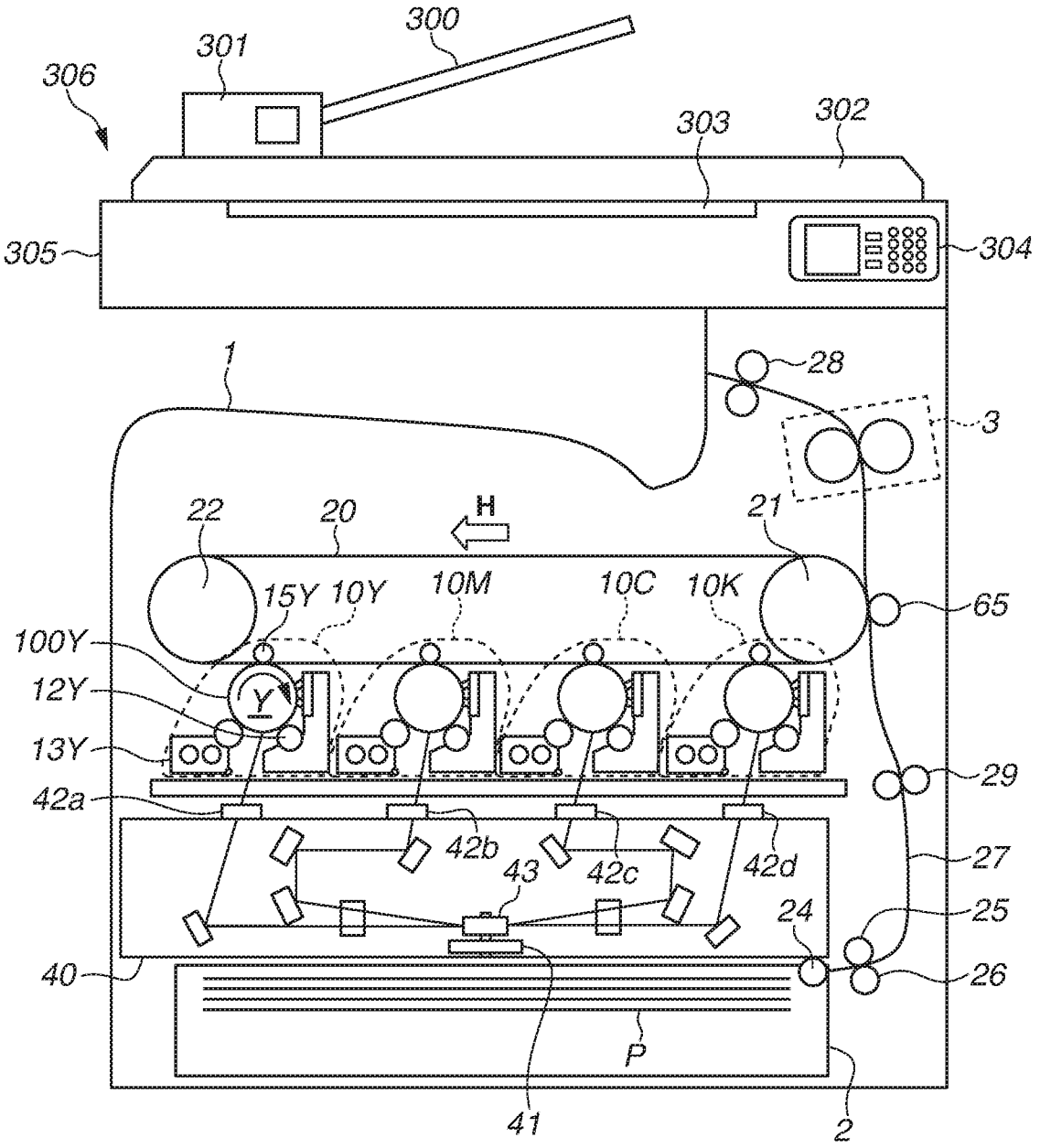
FIG. 1 is a schematic sectional view of an image forming apparatus.

FIG. 1 is a schematic sectional view illustrating the overall configuration of an image forming apparatus 1 according to a first exemplary embodiment. As illustrated in FIG. 1, the image forming apparatus 1 in the present exemplary embodiment is a color laser beam printer of the tandem type equipped with four image forming units 10Y, 10M, 10C, and 10K, which form toner images for respective colors of yellow (Y), magenta (M), cyan (C), and black (K).

As illustrated in FIG. 1, the image forming apparatus 1 in the present exemplary embodiment includes a reader unit 306 located in an upper portion of the main body thereof. The reader unit 306 includes a document conveyance device 301, which automatically conveys a document, a document reading device 305, which reads an image of the conveyed document, and a document discharge tray 302, to which the document is discharged.

The document conveyance device 301 includes a document feeding tray 300, onto which a document is set. The document conveyance device 301 conveys a document placed on the document feeding tray 300 on a sheet-by-sheet basis to a document reading position on a glass 303 of the document reading device 305. The document conveyed onto the glass 303 is read by the document reading device 305. After that, the document conveyance device 301 further conveys the document, and then discharges the document onto the document discharge tray 302.

Figure 6:
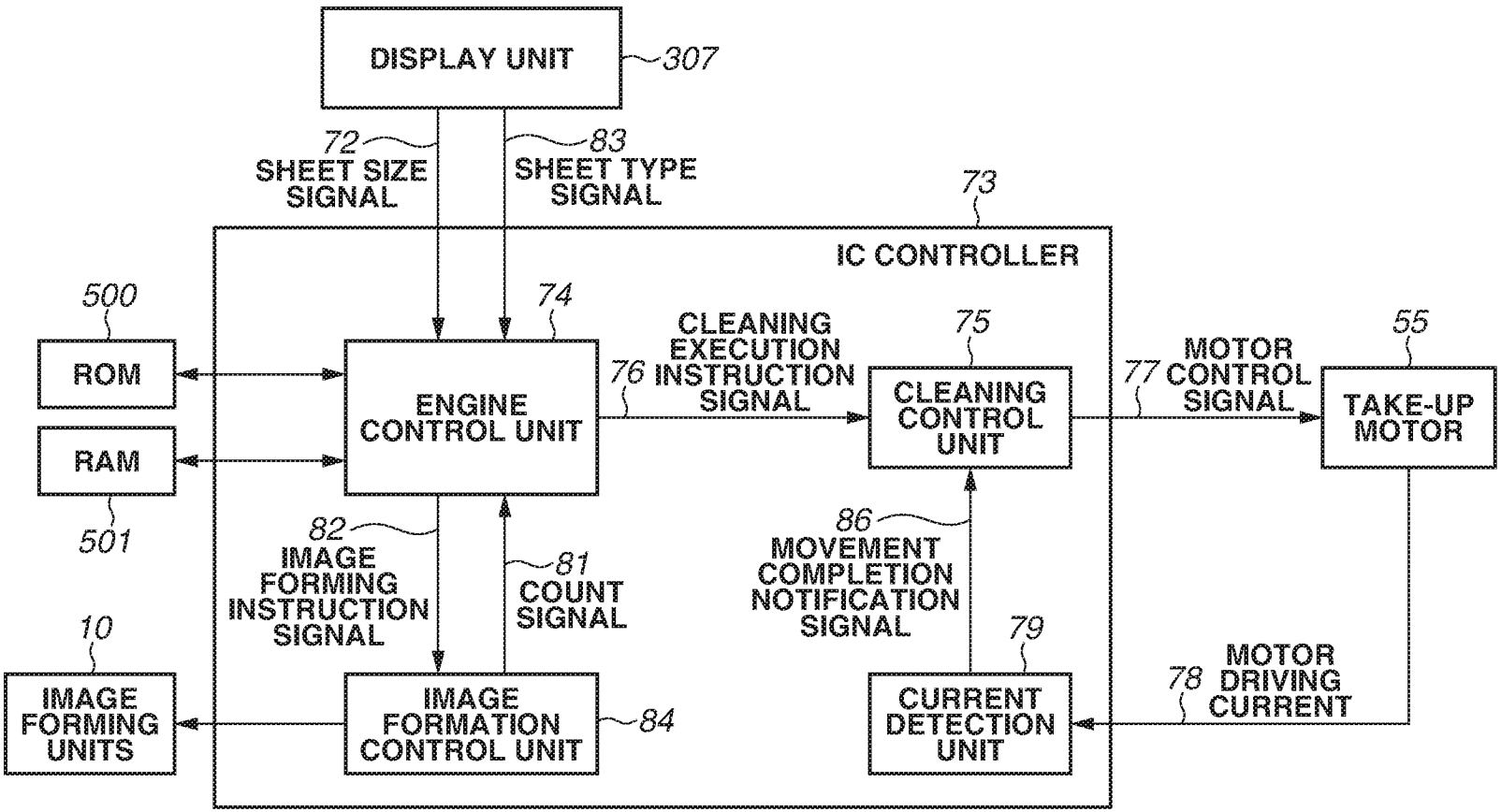
FIG. 6 is a diagram illustrating a control system of the image forming apparatus.

The document reading device 305 includes a scanner and a full-color charge-coupled device (CCD) sensor (each not illustrated). The scanner performs exposure and scanning on the document conveyed onto the glass 303 by the document conveyance device 301. As exposure and scanning are performed on the document by the scanner, the CCD sensor converts reflected light from the document into an electrical signal. With this, an electrical signal for red (r), green (g), and blue (B) components representing an image is transmitted to an image formation control unit 84 (FIG. 6).

The image forming apparatus 1 includes image forming units 10Y, 10M, 10C, and 10K, which transfer an image read by the document reading device 305 onto a recording sheet P to reproduce the image on the recording sheet P. Here, in the present exemplary embodiment, the recording sheet naturally includes plain paper, heavy paper, and thin paper, and extensively further includes, for example, recycled paper and processed paper.

Moreover, as illustrated in FIG. 1, the image forming apparatus 1 in the present exemplary embodiment includes an operation unit 304. The operation unit 304 includes a display unit 307 (FIG. 6), which displays setting information about a printing condition to an operator such as the user or service engineer. The display unit 307 in the present exemplary embodiment is a liquid crystal display.

The display unit 307 is able to display software keys, which are operated by the operator touching the software keys with, for example, the finger. With this, the operator is able to input instruction information about, for example, one-sided printing or two-sided printing, via the display unit 307. The operation unit 304 includes a start key, which is configured to be pressed to start an image forming operation, and a stop key, which is configured to be pressed to stop the image forming operation. A numeric keypad includes keys which are configured to be pressed to perform, for example, numerical setting. While, in the image forming apparatus in the present exemplary embodiment, a start key, a stop key, and a numeric keypad are provided as hardware keys on the operation unit 304, these keys can be displayed as software keys on the display unit 307. Various pieces of data input via the operation unit 304 are stored in a random access memory (RAM) 501 (FIG. 6) via an integrated circuit (IC) controller 73 (FIG. 6).

The image forming apparatus 1 includes an intermediate transfer belt 20, to which toner images formed by the respective image forming units 10Y, 10M, 10C, and 10K are transferred. The intermediate transfer belt 20 is used to transfer the toner images transferred from the respective image forming units 10 to a recording sheet P. Furthermore, the image forming units 10Y, 10M, 10C, and 10K have approximately the same configuration except for colors of toners used for the respective image forming units 10. In the subsequent description, the image forming unit 10Y is described an example of each image forming unit 10. Duplicate descriptions of the image forming units 10M, 10C, and 10K are omitted.

Each image forming unit 10 includes a photosensitive drum 100, a charging roller 12, which electrically charges the photosensitive drum 100 in a uniform manner, a developing device 13, which develops an electrostatic latent image formed on the photosensitive drum 100 by an optical scanning device 40 described below with toner to form a toner image, and a primary transfer roller 15, which transfers the formed toner image to the intermediate transfer belt 20. The primary transfer roller 15 forms a primary transfer portion between the photosensitive drum 100 and the primary transfer roller 15 across the intermediate transfer belt 20, and receives a predetermined transfer voltage applied thereto. With this, the primary transfer roller 15 transfers the toner image formed on the photosensitive drum 100 to the intermediate transfer belt 20. Here, each of the optical scanning device 40 and the developing device 13 is an element included in each image forming unit.

The intermediate transfer belt 20 is an endless belt suspended in a tensioned manner around a first belt conveyance roller 21 and a second belt conveyance roller 22, and is configured to rotationally operate in the direction of arrow H. Toner images formed by the respective image forming units 10 are transferred to the intermediate transfer belt 20, which is rotating. Here, the four image forming units 10Y, 10M, 10C, and 10K are arranged side by side below the intermediate transfer belt 20 as viewed in the vertical direction. With this, toner images formed on the respective photosensitive drums 100 according to image information for the respective colors are transferred to the intermediate transfer belt 20.

Moreover, the first belt conveyance roller 21 and a secondary transfer roller 65 are brought into pressure contact with each other across the intermediate transfer belt 20. With this, the first belt conveyance roller 21 forms a secondary transfer portion between the secondary transfer roller 65 and the first belt conveyance roller 21 across the intermediate transfer belt 20. The recording sheet P is inserted into the secondary transfer portion, so that the toner images are transferred from the intermediate transfer belt 20 to the recording sheet P. Furthermore, transfer residual toner, which remains on the surface of the intermediate transfer belt 20, is recovered by a belt cleaning device (not illustrated).

Here, with regard to the image forming units 10 for the respective colors, the image forming unit 10Y, which forms a toner image for yellow, the image forming unit 10M, which forms a toner image for magenta, the image forming unit 10C, which forms a toner image for cyan, and the image forming unit 10K, which forms a toner image for black, are arranged in order from the upstream side with respect to the secondary transfer portion in the rotational direction of the intermediate transfer belt 20 (in the direction of arrow H).

Moreover, the optical scanning device 40, which performs scanning of laser light on the respective photosensitive drums 100 and thus forms electrostatic latent images on the respective photosensitive drums 100, is located below the image forming units 10 as viewed in the vertical direction.

The optical scanning device 40 includes a rotary polygonal mirror 43 and four semiconductor lasers (not illustrated), which emit laser beams modulated according to pieces of image information for the respective colors. Such four semiconductor lasers are light sources used to perform exposure on the corresponding photosensitive drums 100. The rotary polygonal mirror 43 is rotated at high speed by a polygon motor (not illustrated). With this, the laser beams emitted from the respective semiconductor lasers are deflected in a scanning manner along the rotational axis direction of each photosensitive drum 100. The respective laser beams deflected by the rotary polygonal mirror 43 are guided by optical members such as lenses located inside the optical scanning device 40 and are then emitted from the inside of the optical scanning device 40 to the outside thereof via transparent members (examples of transparent windows) 42*a* to 42*d*, which respectively cover opening portions provided at an upper portion of the optical scanning device 40. The photosensitive drums 100 are exposed to the respective laser beams emitted from the optical scanning device 40.

On the other hand, recording sheets P are stored in a sheet feeding cassette 2 (an example of a sheet feeding unit), which is located at a lower portion of the image forming apparatus 1. Then, a recording sheet P is fed by a pickup roller 24 to a separation nip portion formed by a sheet feeding roller 25 and a retard roller 26. Here, transmission of drive is configured in such a manner that the retard roller 26 rotates backward when a plurality of recording sheets P has been concurrently fed by the pickup roller 24. With this, recording sheets P are conveyed on a sheet-by-sheet basis to the downstream side, so that double feeding of recording sheets P is prevented. The recording sheet P conveyed by the sheet feeding roller 25 and the retard roller 26 on a sheet-by-sheet basis is conveyed to a conveyance path 27, which extends approximately in a vertical fashion along the right lateral side of the image forming apparatus 1. Furthermore, a recording sheet P can be fed not from the sheet feeding cassette 2 but from, for example, the document feeding tray 300 (an example of a sheet feeding unit).

Then, the recording sheet P is conveyed from the lower side in the vertical direction of the image forming apparatus 1 to the upper side in the vertical direction of the image forming apparatus 1 through the conveyance path 27, and is then conveyed to a registration roller 29. The registration roller 29 temporarily stops the recording sheet P, which has been conveyed, and corrects skewing of the recording sheet P. After that, the registration roller 29 conveys the recording sheet P to the secondary transfer portion in conformity with timing at which the toner images formed on the intermediate transfer belt 20 are conveyed to the secondary transfer portion. After that, the recording sheet P to which the toner images have been transferred at the secondary transfer portion is conveyed to a fixing device 3, so that the toner images are pressed and heated by the fixing device 3 and are thus fixed to the recording sheet P. Then, the recording sheet P having the toner images fixed thereto is discharged by a discharge roller 28 to a discharge tray located outside the image forming apparatus 1 and in an upper portion of the main body of the image forming apparatus 1.

<Cleaning Mechanism>

The image forming apparatus 1 has a configuration in which the optical scanning device 40 is located below the image forming units 10. Therefore, in some cases, a foreign substance, such as toner, paper dust, or mote, may fall onto the transparent members 42*a* to 42*d*, which are provided in an upper portion of the optical scanning device 40. In these cases, laser beams which are radiated toward the photosensitive drums 100 via the transparent members 42*a* to 42*d* may be blocked by the foreign substance. Accordingly, a change in optical property may occur in the optical scanning device 40, so that the quality of an image to be formed may decrease.

Figure 2:
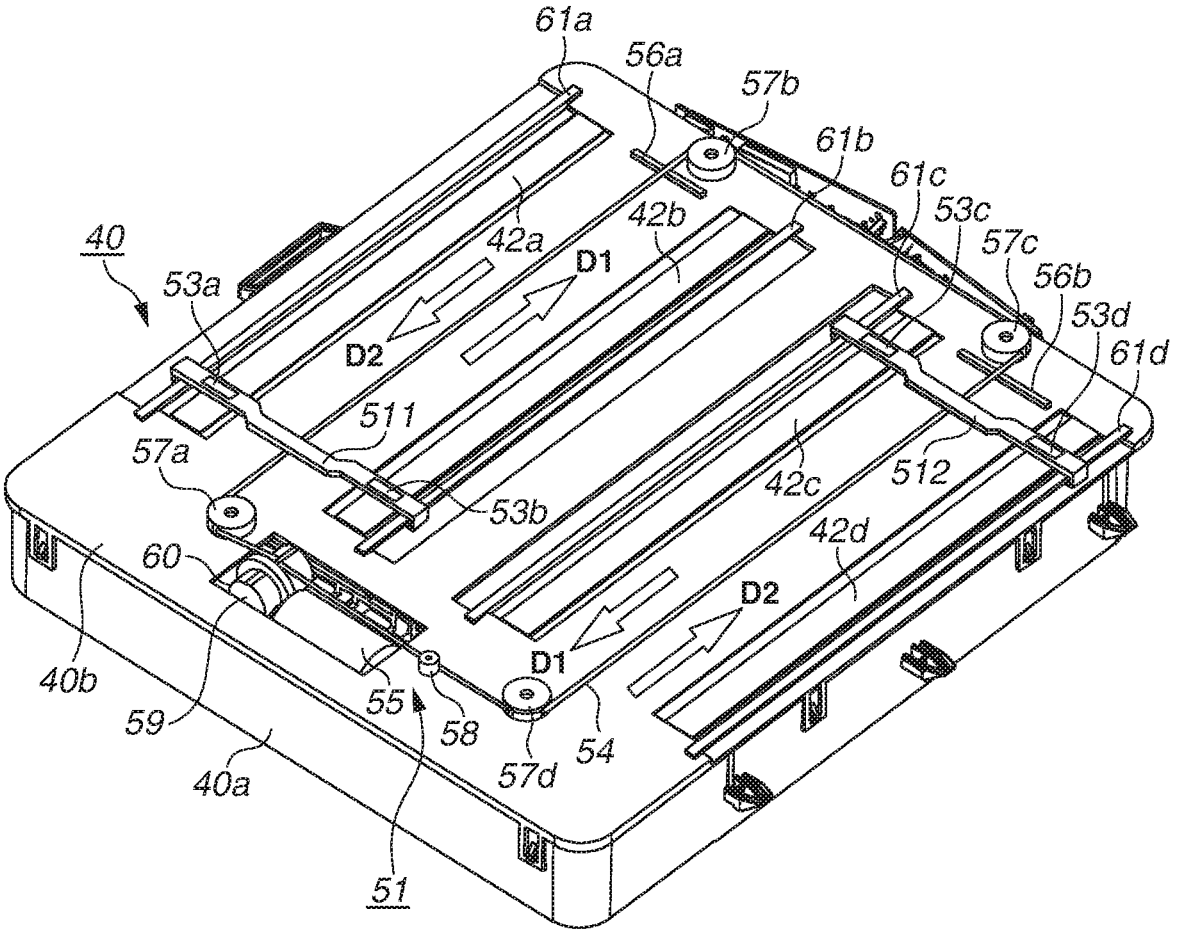
FIG. 2 is a perspective view of an optical scanning device.

Therefore, in the present exemplary embodiment, the image forming apparatus 1 includes a cleaning mechanism 51, which is configured to clean the transparent members 42*a* to 42*d* of the optical scanning device 40. In the following description, the optical scanning device 40 and the cleaning mechanism 51, which is provided for the optical scanning device 40, are described in detail. FIG. 2 is a perspective view illustrating the entire optical scanning device 40, and FIG. 3 is a top view of the optical scanning device 40.

Figure 3:
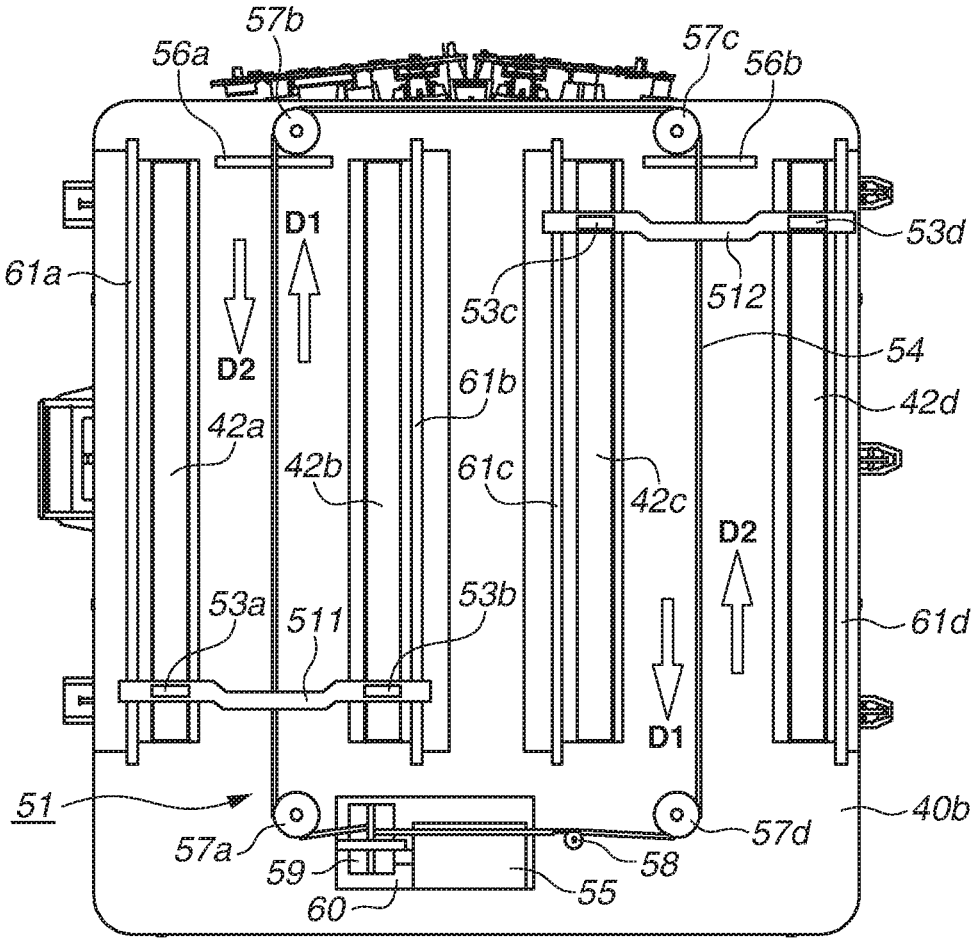
FIG. 3 is a top view of the optical scanning device.

As illustrated in FIG. 2 and FIG. 3, the optical scanning device 40 includes a container portion 40*a*, which contains therein a motor unit 41 (FIG. 1) and the rotary polygonal mirror 43 (FIG. 1), and a cover portion 40*b*, which is attached to the container portion 40*a* and covers the top side of the container portion 40*a*. Here, the casing of the optical scanning device 40 is configured with the container portion 40*a* and the cover portion 40*b*. The cover portion 40*b* is provided with four opening portions, through which laser beams pass with respect to the photosensitive drums 100 for the respective colors, and each opening portion is of a rectangular shape elongated in the rotational axis direction of the associated photosensitive drum 100 and the respective opening portions are formed in such a way as to extend in the longitudinal direction thereof in parallel with each other. Then, the respective opening portions are occluded by the transparent members 42*a* to 42*d*, each of which is formed in an elongated rectangular shape. The transparent members 42*a* to 42*d*, the number of which is four as with the opening portions, are attached to the cover portion 40*b* in such a way as to extend in the longitudinal direction thereof in parallel with each other. Furthermore, the longitudinal direction of each of the transparent members 42*a* to 42*d* is approximately equal to the scanning direction of laser light which is emitted from the optical scanning device 40. Moreover, in the present exemplary embodiment, the longitudinal direction of each of the transparent members 42*a* to 42*d* is approximately equal to the rotational axis direction of the associated one of the photosensitive drums 100.

Here, the transparent members 42*a* to 42*d* are provided to prevent a foreign substance, such as toner, mote, or paper dust, from intruding into the optical scanning device 40, thus preventing a decrease in image quality from occurring due to a foreign substance adhering to, for example, the semiconductor laser, the mirrors, or the rotary polygonal mirror 43. Each of the transparent members 42*a* to 42*d* is formed from a transparent material such as glass, and is configured to allow laser light emitted from the semiconductor laser contained in the container portion 40*a* to be radiated toward the photosensitive drum 100. In the present exemplary embodiment, the size of each of the transparent members 42*a* to 42*d* is set larger than the opening of each opening portion, and the transparent members 42*a* to 42*d* are configured to cover the respective opening portions in an overlapping manner. Then, the transparent members 42*a* to 42*d* are fixed to the cover portion 40*b* by bonding the overlapped portions of the transparent members 42*a* to 42*d* to the respective opening portions.

In this way, the optical scanning device 40 is configured to be covered by the cover portion 40*b* and the transparent members 42*a* to 42*d* in such a manner that a foreign substance, such as toner, paper dust, or mote, does not intrude into the optical scanning device 40. Moreover, since the transparent members 42*a* to 42*d*, each of which is larger than each opening portion, are bonded and fixed onto the cover portion 40*b*, a foreign substance, such as toner, paper dust, or mote, which may fall from above the optical scanning device 40, is prevented from intruding into the optical scanning device 40 through clearance gaps between the transparent members 42*a* to 42*d* and the respective opening portions.

Then, in the present exemplary embodiment, the image forming apparatus 1 includes the cleaning mechanism 51, which cleans off a foreign substance having fallen from above to the top surface of the optical scanning device 40 (the top surfaces of the transparent members 42*a* to 42*d*). Here, the top surfaces of the transparent members 42*a* to 42*d* are outside surfaces with respect to the optical scanning device 40 and are surfaces from which laser beams passing through the transparent members 42*a* to 42*d* exit.

The cleaning mechanism 51 is attached onto the cover portion 40*b* of the optical scanning device 40 at the side facing the image forming units 10. The cleaning mechanism 51 includes cleaning members 53*a* to 53*d*, which are configured to respectively clean the top surfaces of the transparent members 42*a* to 42*d*, and a first cleaning holder 511 and a second cleaning holder 512, which hold the cleaning members 53*a* to 53*d* and move the cleaning members 53*a* to 53*d* on the transparent members 42*a* to 42*d*.

Each of the first cleaning holder 511 and the second cleaning holder 512 extends between two adjacent transparent members 42 in a direction perpendicular to the direction in which each transparent member 42 extends, and includes two cleaning members 53. Here, the number of cleaning members 53 included in the first cleaning holder 511 and the second cleaning holder 512 corresponds to the number of transparent members 42.

More specifically, the first cleaning holder 511 is located in such a way as to extend between the transparent members 42*a* and 42*b*, and includes the cleaning member 53*a*, which cleans the top surface of the transparent member 42*a*, and the cleaning member 53*b*, which cleans the top surface of the transparent member 42*b*. Moreover, the second cleaning holder 512 is located in such a way as to extend between the transparent members 42*c* and 42*d*, and includes the cleaning member 53*c*, which cleans the top surface of the transparent member 42*c*, and the cleaning member 53*d*, which cleans the top surface of the transparent member 42*d*.

Each of the cleaning members 53*a* to 53*d* is made from, for example, silicon rubber or unwoven cloth. The cleaning members 53 move while being in contact with the top surfaces of the transparent members 42 in conjunction with the movement of the first cleaning holder 511 and the second cleaning holder 512. With this, the cleaning members 53 are able to remove foreign substances on the transparent members 42.

The first cleaning holder 511 has a central portion coupled to a wire 54. Moreover, the first cleaning holder 511 is configured to hold the cleaning members 53*a* and 53*b* at both ends of the first cleaning holder 511 across the wire 54. The second cleaning holder 512 has a central portion coupled to the wire 54. Moreover, the second cleaning holder 512 is configured to hold the cleaning members 53*c* and 53*d* at both ends of the second cleaning holder 512 across the wire 54. Accordingly, the wire 54 is stretched in a tensioned state in such a way as to pass between the transparent members 42*a* and 42*b* and between the transparent members 42*c* and 42*d*.

Moreover, the wire 54 is stretched in a tensioned state in a circular manner on the cover portion 40*b* with use of four tensile stretching pulleys 57*a* to 57*d*, which are rotatably held on the cover portion 40*b*, a tension adjusting pulley 58, and a take-up drum 59. Then, the wire 54 is stretched in a tensioned state around the tensile stretching pulleys 57*a* to 57*d* in the state in which the length of the wire 54 was adjusted by the wire 54 being taken up a predetermined number of turns around the take-up drum 59 during assembly of the apparatus. At this time, as mentioned above, the four tensile stretching pulleys 57*a* to 57*d* are arranged in such a manner that the wire 54 passes between the transparent members 42*a* and 42*b* and between the transparent members 42*c* and 42*d*.

The tension of the wire 54 is adjusted by the tension adjusting pulley 58, which is located between the tensile stretching pulleys 57*a* and 57*d*. Therefore, the wire 54 is placed in a tensioned state without slack between the tensile stretching pulleys 57, the tension adjusting pulley 58, and the take-up drum 59. With this, since the wire 54 is stretched in a tensioned state, it is possible to cause the wire 54 to smoothly run in a circular way.

While, in the present exemplary embodiment, a configuration in which the tension adjusting pulley 58 is located between the tensile stretching pulleys 57*a* and 57*d* is employed, the location of the tension adjusting pulley 58 does not need to be limited to such a position as long as the position is available to adjust the tension of the wire 54 suspended in a tensioned manner around the tensile stretching pulleys 57*a* to 57*d*.

In this way, in the present exemplary embodiment, a configuration in which the first cleaning holder 511 is provided with the cleaning members 53*a* and 53*b* and the second cleaning holder 512 is provided with the cleaning members 53*c* and 53*d* is employed. On the other hand, in a case where one cleaning holder is provided with one cleaning member, a number of cleaning holders corresponding to the number of transparent members need to be provided, so that the length of the wire stretched in a tensioned state to move the cleaning holders becomes large. Accordingly, in the present exemplary embodiment, as compared with a configuration in which one cleaning member is held by one cleaning holder, it is possible to reduce the number of cleaning holders and it is possible to make the length of the wire 54 shorter, so that it is possible to clean the top surfaces of the transparent members 42*a* to 42*d* with a simpler configuration.

Moreover, the take-up drum 59 is configured to be able to be rotated by driving of a take-up motor 55 serving as a drive unit. The take-up drum 59 is configured to be able to rotate forward and backward. In the present exemplary embodiment, the forward rotation of the take-up motor 55 is set as the clockwise (CW) direction, and the backward direction thereof is set as the counterclockwise (CCW) direction.

Accordingly, the wire 54 is configured to be taken up onto and paid out from the take-up drum 59 by the take-up drum 59 being rotated by the rotation of the take-up motor 55 in the CW direction or CCW direction. In this way, when being taken up and paid out by the take-up drum 59, the wire 54 is able to run in a circular manner on the cover portion 40*b* while being suspended in a tensioned manner by the tensile stretching pulleys 57.

Therefore, the first cleaning holder 511 and the second cleaning holder 512, which are coupled to the wire 54, are able to move in the directions of arrows D1 and D2 in association with running of the wire 54. In the present exemplary embodiment, as the take-up motor 55 rotates in the CCW direction, the first cleaning holder 511 and the second cleaning holder 512 move in the direction of arrow D1. Moreover, as the take-up motor 55 rotates in the CW direction, the first cleaning holder 511 and the second cleaning holder 512 move in the direction of arrow D2.

Since the wire 54 is stretched in a tensioned state in a circular manner, the first cleaning holder 511 and the second cleaning holder 512 are configured to move in the respective opposite directions in a linear manner along the longitudinal direction of each of the transparent members 42*a* to 42*d* in association with movement of the wire 54.

Here, the take-up motor 55 and the take-up drum 59 are located in a recessed portion 60, which is provided in such a way as to be recessed with respect to the top surface of the cover portion 40*b*. This enables reducing the size of the optical scanning device 40 in the height direction thereof. Furthermore, the recessed portion 60 does not communicate with the inside of the optical scanning device 40, so that a foreign substance also does not intrude into the optical scanning device 40 from the recessed portion 60.

Moreover, the cover portion 40*b* is provided with a first stopper 56*a*, which limits the movement of the first cleaning holder 511 in the longitudinal direction of each of the transparent members 42*a* and 42*b*. Moreover, the cover portion 40*b* is also provided with a second stopper 56*b*, which limits the movement of the second cleaning holder 512 in the longitudinal direction of each of the transparent members 42*c* and 42*d*.

The first stopper 56*a* and the second stopper 56*b* are located at one end side in the longitudinal direction of each of the transparent members 42*a* to 42*d*. Accordingly, when the first cleaning holder 511 and the second cleaning holder 512 are moving in the direction of arrow D1, the first cleaning holder 511 arrives at the end portions of the transparent members 42*a* and 42*b* in the direction of arrow D1, thus coming into contact with the first stopper 56*a*.

With this, since the movement of the first cleaning holder 511 in the direction of arrow D1 is limited by the first stopper 56*a*, a load acting on the take-up motor 55, which rotates the take-up drum 59 to cause the wire 54 to run, becomes large. Such a load is detected with use of a current detection unit described below, so that the first cleaning holder 511 having arrived at the first stopper 56*a* is detected. At this time, the second cleaning holder 512 is situated at the side opposite to the side at which the first cleaning holder 511 is situated in the longitudinal direction of each of the transparent members 42.

Furthermore, a series of cleaning operations performed with the movement of the first cleaning holder 511 and the second cleaning holder 512 in the present exemplary embodiment is as follows.

First, when the take-up motor 55 is driven to rotate in the CW direction, the wire 54 runs in the direction of arrow D2, so that the first cleaning holder 511 and the second cleaning holder 512 move in the direction of arrow D2.

After that, the second cleaning holder 512 arrives at the end portions of the transparent members 42*c* and 42*d* in the direction of arrow D2, thus coming into contact with the second stopper 56*b*. With this, since the movement of the second cleaning holder 512 in the direction of arrow D2 is limited by the second stopper 56*b*, a load acting on the take-up motor 55, which rotates the take-up drum 59 to cause the wire 54 to run, becomes large. Such a load is detected with use of a current detection unit described below, so that the second cleaning holder 512 having arrived at the second stopper 56*b* is detected.

Then, when the second cleaning holder 512 having arrived at the second stopper 56*b* has been detected, the take-up motor 55 is stopped from rotating. At this time, the first cleaning holder 511 arrives at the other end side in the longitudinal direction of each of the transparent members 42. Accordingly, when the take-up motor 55 is stopped from rotating, the first cleaning holder 511 is stopped from moving at the other end side in the longitudinal direction of each of the transparent members 42.

After that, the take-up motor 55 is rotated in the CCW direction, thus causing the wire 54 to run in the direction of arrow D1. With this, each of the first cleaning holder 511 and the second cleaning holder 512 moves in the direction of arrow D1.

After that, the first cleaning holder 511 arrives at the end portions of the transparent members 42*a* and 42*b* in the direction of arrow D1, thus coming into contact with the first stopper 56*a*. With this, since the movement of the first cleaning holder 511 in the direction of arrow D1 is limited by the first stopper 56*a*, a load acting on the take-up motor 55, which rotates the take-up drum 59 to cause the wire 54 to run, becomes large. Such a load is detected with use of a current detection unit described below, so that the first cleaning holder 511 having arrived at the first stopper 56*a* is detected.

Then, when the first cleaning holder 511 having arrived at the first stopper 56*a* has been detected, the take-up motor 55 is stopped from rotating in the CCW direction and is then rotated a predetermined number of rotations in the CW direction. With this, after the wire 54 is caused to run a predetermined distance in the direction of arrow D2, the take-up motor 55 is stopped from rotating.

In this way, in the present exemplary embodiment, each of the first cleaning holder 511 and the second cleaning holder 512 performing one reciprocating movement on the transparent members 42*a* to 42*d* is defined as a series of cleaning operations. Then, after the series of cleaning operations is ended, the wire 54 is caused to run a predetermined distance in the direction of arrow D2 and is then stopped, so that the operation of the first cleaning holder 511 is stopped at a position where the first cleaning holder 511 is not kept in contact with the first stopper 56*a* and the cleaning members 53 are not in contact with the surfaces of the transparent members 42.

In other words, the first cleaning holder 511 is stopped at a position in a non-passage region which is between the end portions of the transparent members 42 in the longitudinal direction of each of the transparent members 42 and the first stopper 56*a* and in which laser light does not pass through the transparent members 42. Furthermore, at this time, the second cleaning holder 512 is stopped at a position where the second cleaning holder 512 is not kept in contact with the end portions of the transparent members 42 in the longitudinal direction thereof, i.e., in a non-passage region in which laser light does not pass through the transparent members 42. Here, the stopping positions of the first cleaning holder 511 and the second cleaning holder 512 taken when a series of cleaning operations is ended are normal stopping positions and are thus cleaning start positions. Furthermore, in the present exemplary embodiment, as mentioned above, the unit of "a series of cleaning operations" is set as the first cleaning holder 511 and the second cleaning holder 512 performing one reciprocating movement on the transparent members 42*a* to 42*d*. However, the unit of "a series of cleaning operations" can be set as the first cleaning holder 511 and the second cleaning holder 512 performing only a one-way movement on the transparent members 42*a* to 42*d*, or can be set as the first cleaning holder 511 and the second cleaning holder 512 performing, for example, two reciprocating movements on the transparent members 42*a* to 42*d*.

Furthermore, while, in the present exemplary embodiment, a configuration in which the take-up motor 55 is rotated forward (rotated in the CW direction) to cause the wire 54 to run in the direction of arrow D1 and the take-up motor 55 is rotated backward (rotated in the CCW direction) to cause the wire 54 to run in the direction of arrow D2 is employed, a configuration in which the take-up motor 55 is rotated forward to cause the wire 54 to run in the direction of arrow D2 and the take-up motor 55 is rotated backward to cause the wire 54 to run in the direction of arrow D1 can be employed.

Moreover, the cover portion 40*b* is provided with guide members 61*a* to 61*d*, which are configured to guide the movement of the first cleaning holder 511 and the second cleaning holder 512. Then, as illustrated in FIG. 4 and FIG. 5, both end portions of the first cleaning holder 511 respectively engage with the guide members 61*a* and 61*b*.

Figure 4:
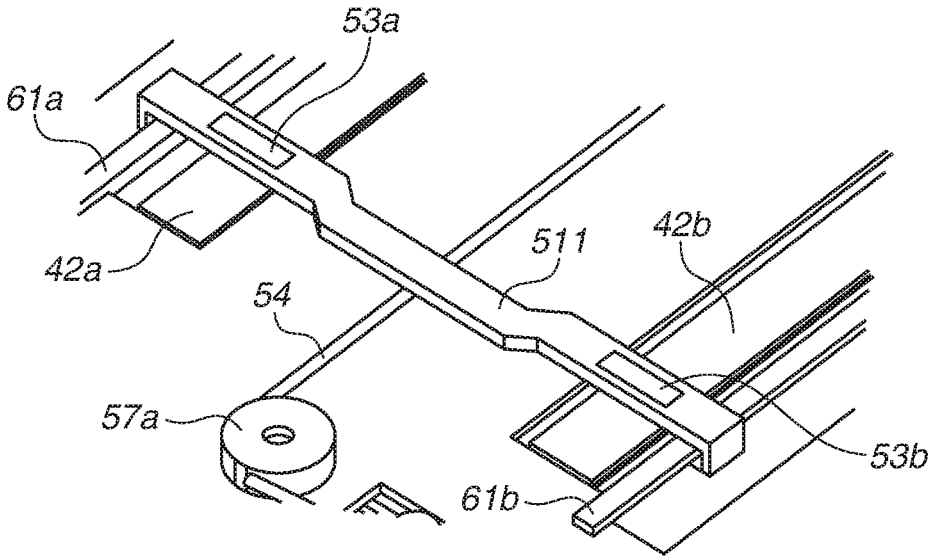
FIG. 4 is a partial perspective view of a first cleaning holder.

Here, FIG. 4 is a partial perspective view illustrating the vicinity of the first cleaning holder 511. Furthermore, with regard to the second cleaning holder 512, as with the first cleaning holder 511, both end portions of the second cleaning holder 512 respectively engage with the guide members 61*c* and 61*d*. FIG. 5 is a partial sectional view illustrating an end portion at the side where the cleaning member 53*a* of the first cleaning holder 511 is held. While, here, only the configuration of the first cleaning holder 511 is described, in the present exemplary embodiment, the same configuration is assumed to be also used for the second cleaning holder 512.

Figure 5:
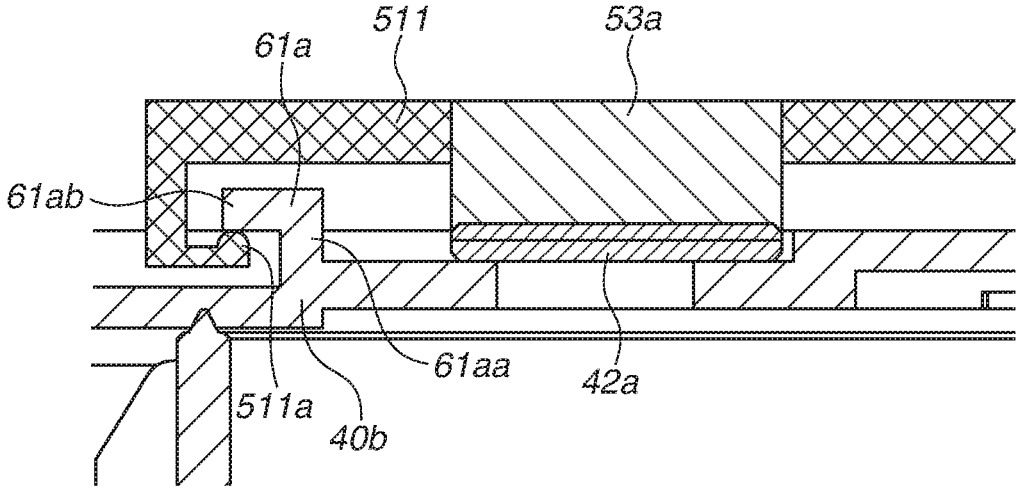
FIG. 5 is a partial sectional view of the first cleaning holder.

As illustrated in FIG. 4 and FIG. 5, the guide members 61*a* to 61*d* are formed integrally with the cover portion 40*b* and are provided to project from the top surface of the cover portion 40*b* upward.

Here, each of the guide members 61*a* to 61*d* includes, as illustrated in FIG. 5, a first projecting portion 61*aa*, which projects from the top surface of the cover portion 40*b* upward, and a second projecting portion 61*ab*, which extends from the first projecting portion 61*aa* in a direction away from the cleaning member 53*a*.

Then, an end portion 511*a* at one side of the first cleaning holder 511 is formed in such a way as to get into under the second projecting portion 61*ab*. Here, the end portion 511*a* is configured to have a circular arc-like portion with which the second projecting portion 61*ab* is in contact. In this way, since the end portion 511*a* has a circular arc-like portion, it is possible to reduce a sliding resistance occurring when the first cleaning holder 511 moves in the direction of arrow D1 or the direction of arrow D2 (see FIG. 3).

Furthermore, while, in the present exemplary embodiment, only one end side of the first cleaning holder 511 is described in detail, the other end side thereof is assumed to also have a similar configuration. Moreover, the second cleaning holder 512 is assumed to also have a similar shape.

Moreover, since the first cleaning holder 511 and the second cleaning holder 512 engage with the guide members 61*a* to 61*d*, it is possible to prevent or reduce the cleaning members 53*a* to 53*d* from moving in a direction away from the transparent members 42*a* to 42*d*. At this time, positions of engagement between the first cleaning holder 511 and the second cleaning holder 512 and the guide members 61*a* to 61*d* are set as positions where the cleaning members 53*a* to 53*d* are in contact with the transparent members 42*a* to 42*d* at a predetermined contact pressure.

Moreover, in the present exemplary embodiment, the guide members 61*a* to 61*d*, the first stopper 56*a*, and the second stopper 56*b* are configured to be formed from resin integrally with the cover portion 40*b*, but can be configured to be formed separately from the cover portion 40*b*.

<Control System of Image Forming Apparatus>

FIG. 6 is a control block diagram illustrating a control configuration for performing a cleaning operation in the present exemplary embodiment. As illustrated in FIG. 6, the IC controller 73 includes, as built-in modules, an engine control unit 74, a cleaning control unit 75, which controls the take-up motor 55, a current detection unit 79, which detects a driving current for the take-up motor 55, and an image formation control unit 84, which controls the image forming units 10 to perform an image forming operation. The IC controller 73 is configured to control the display unit 307, the take-up motor 55, and the image forming units 10 via the various modules. In the subsequent description, control of a cleaning operation which the IC controller 73 performs via the various modules is described.

The IC controller 73 reads out a program stored in a read-only memory (ROM) 500 via the engine control unit 74, and performs various control operations with a random access memory (RAM) 501 used a work area and a temporary storage area for data. The IC controller 73 causes the display unit 307 to display information about sizes and types of recording sheets or to display information for promoting an operator, such as the user or service engineer, to select a printing type, such as one-side printing or two-sided printing. The display unit 307 is configured with, for example, a touch panel of the resistance film type or capacitance type stacked on a display panel of the liquid crystal display type. The IC controller 73 is able to acquire, via the display unit 307, information about the size and type of recording sheets set by the operator and to inform the operator of various pieces of information via the display unit 307.

Figure 7A:
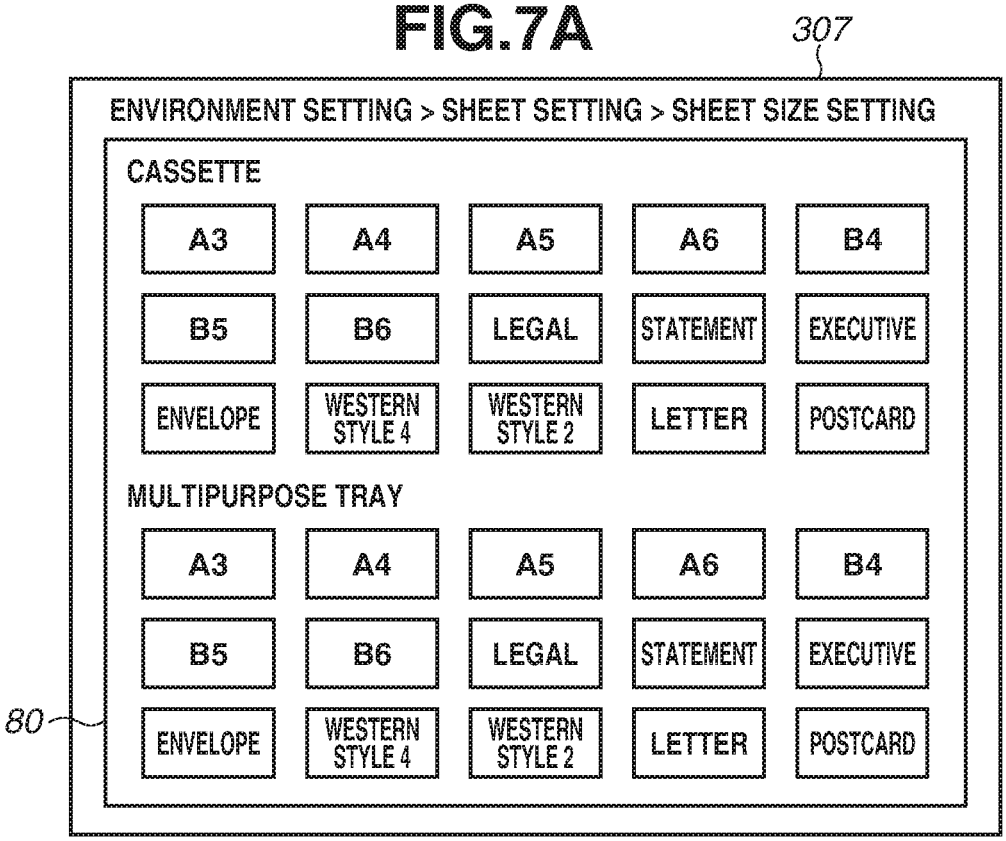
FIGS. 7A and 7B are diagrams illustrating examples of user interfaces to be displayed on an operation unit.
Figure 7B:
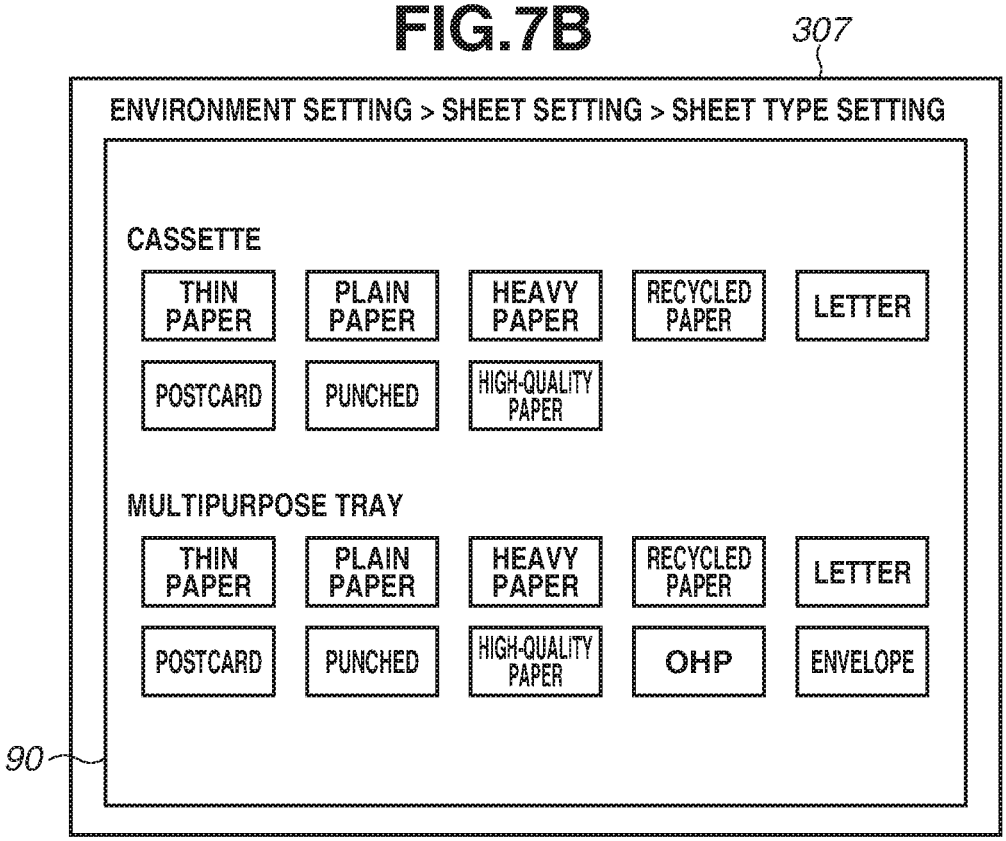

Here, examples of screens which the display unit 307 displays in the present exemplary embodiment are illustrated in FIG. 7A and FIG. 7B. FIG. 7A illustrates a screen in which information for setting the size of recording sheets is displayed. The operator is allowed to set and register an optional size with regard to the size of recording sheets via such a screen. The display unit 307 and the IC controller 73 function as a registration unit. Furthermore, although details are described below, a configuration in which, in response to recording sheets being placed on the document feeding tray 300, the image forming apparatus 1 automatically reads the size of recording sheets based on the position of a regulation plate (not illustrated) can be employed. In this case, without the operator setting the size of recording sheets via the operation unit 304, the size of recording sheets to be fed is automatically set by the image forming apparatus 1.

The set size information about recording sheets is transmitted as a sheet size signal 72 to the engine control unit 74 in the IC controller 73.

Moreover, FIG. 7B illustrates a screen on the display unit 307 in which information for setting the type of recording sheets is displayed. Via such a screen, the operator is allowed to optionally set the type of recording sheets. Information about the type of recording sheets set by the operator is transmitted as a sheet type signal 83 to the engine control unit 74 in the IC controller 73. Furthermore, specific examples of the "size of recording sheets" and the "type of recording sheets" as mentioned herein are described below.

Here, the IC controller 73 causes the engine control unit 74 to transmit an image forming instruction signal 82 to the image formation control unit 84. Moreover, the IC controller 73 includes a counter which counts, via a count signal 81, the number of times of image formation being performed per page for recording sheets. The counting method can include performing one count when a recording sheet has passed or performing one count when image formation has been performed based on the image formation control unit 84 or can include performing one count when a video count value counted by a video counting unit (not illustrated) corresponds to a predetermined number or more images. Counting the number of times of image formation being performed can include performing one count each time image formation is performed on one recording sheet or performing one count each time image formation is performed on any one of obverse and reverse pages of one recording sheet. For example, in a case where two-sided printing is performed on an A4 recording sheet, such "one recording sheet" becomes equal to "a sheet of two pages". In this way, the number of image-formed pages of recording sheets or the number of image-formed recording sheets is counted.

In the present exemplary embodiment, the engine control unit 74 calculates a count value (=pv_cnt) by weighting the count value counted by the counter based on the sheet size signal 72 and the sheet type signal 83. After that, the IC controller 73 compares the calculated count value with a threshold value (=cln_lim) previously stored in the RAM 501, and, in a case where the count value exceeds the threshold value stored in the RAM 501, the IC controller 73 generates a signal for cleaning instruction. In response to the signal for cleaning instruction being generated by the IC controller 73, a cleaning operation is performed. Furthermore, the value in response to which a cleaning operation is performed can be the count value or can be the number of times of counting. Moreover, as mentioned above, the number of image-formed recording sheets can be counted for every sheet, or the number of image-formed pages of recording sheets can be counted for every page. In this way, the number of image-formed pages is counted by the counter.

Moreover, while, in the present exemplary embodiment, a configuration in which the threshold value is stored in the RAM 501 provided outside the IC controller 73 is employed, a configuration in which the threshold value is stored in an internal storage area such as that provided inside the IC controller 73 can be employed.

If the above-mentioned count value calculated by the engine control unit 74 exceeds the threshold value, the IC controller 73 causes the engine control unit 74 to transmit a cleaning execution instruction signal 76 to the cleaning control unit 75. Then, the IC controller 73 causes the cleaning control unit 75 to transmit a motor control signal 77 to the take-up motor 55, thus driving the take-up motor 55 for rotation. On the other hand, during a cleaning operation, the IC controller 73 causes the current detection unit 79 to detect a motor driving current 78 output from the take-up motor 55.

Here, the take-up motor 55 is driven at a fixed voltage, and, when the first cleaning holder 511 or the second cleaning holder 512 comes into contact with the first stopper 56*a* or the second stopper 56*b*, the motor driving current 78 increases in response to a load acting on the take-up motor 55 becoming large.

Accordingly, when the motor driving current 78 detected by the current detection unit 79 has become larger than a predetermined value, the IC controller 73 detects that the first cleaning holder 511 or the second cleaning holder 512 has come into contact with the first stopper 56*a* or the second stopper 56*b* and the movement in one way from end portions of the transparent members 42*a* to 42*d* to the other end portions thereof has been ended. In other words, the IC controller 73 detects that cleaning in one way in the reciprocating movement has been ended. Accordingly, in response to detecting that the motor driving current 78 has become larger than the predetermined value, the IC controller 73 causes the current detection unit 79 to transmit a movement completion notification signal 86 the cleaning control unit 75.

Furthermore, the predetermined value as mentioned herein is a value larger than the driving current value flowing through the take-up motor 55 during a period in which the first cleaning holder 511 or the second cleaning holder 512 is moving on the transparent members 42. In other words, the predetermined value is a value larger than the driving current value which is flowing through the take-up motor 55 before the first cleaning holder 511 or the second cleaning holder 512 comes into contact with the first stopper 56*a* or the second stopper 56*b*. Moreover, the predetermined value is set to a value which is available to detect that the first cleaning holder 511 or the second cleaning holder 512 has come into contact with the first stopper 56*a* or the second stopper 56*b* and which does not include the value of a current that increases due to a variation such as a malfunction of the take-up motor 55. Furthermore, the determination of ending of the movement of the first cleaning holder 511 and the second cleaning holder 512 from one end to the other end of each of the transparent members 42*a* to 42*d* in the longitudinal direction thereof can be performed not by making a comparison with the predetermined value but by determining the amount of change of the driving current value flowing through the take-up motor 55.

When it is determined that the cleaning operation has been completed, the IC controller 73 causes the engine control unit 74 and the cleaning control unit 75 to stop the take-up motor 55, and transmits a signal for cleaning completion notification to the display unit 307. Since displaying indicating that cleaning has been completed is made on the display unit 307, the operator is informed that the cleaning operation has been completed. On the other hand, if it is determined that the cleaning operation has not yet been completed, the IC controller 73 causes the engine control unit 74 to transmit the cleaning execution instruction signal 76 to the cleaning control unit 75 again, and causes the cleaning control unit 75 to control the take-up motor 55, thus repeating the cleaning operation. Furthermore, the cleaning control unit 75 is able to perform control to cause the first cleaning holder 511 and the second cleaning holder 512 to perform a reciprocating movement by causing the take-up motor 55 to rotate forward and backward.

While, here, a configuration in which the engine control unit 74, the cleaning control unit 75, and the current detection unit 79 are incorporated in the IC controller 73 is employed, this configuration does not necessarily need to be employed. For example, a configuration in which modules different from the modules incorporated in the IC controller 73 described in the present exemplary embodiment are used to implement control for cleaning by the IC controller 73 can also be employed, or a configuration in which the ROM 500 and the RAM 501 are incorporated in the IC controller 73 can also be employed.

<Cleaning Sequence>

Next, control concerning cleaning by the engine control unit 74 in the present exemplary embodiment is described with reference to FIG. 8.

Figure 8:
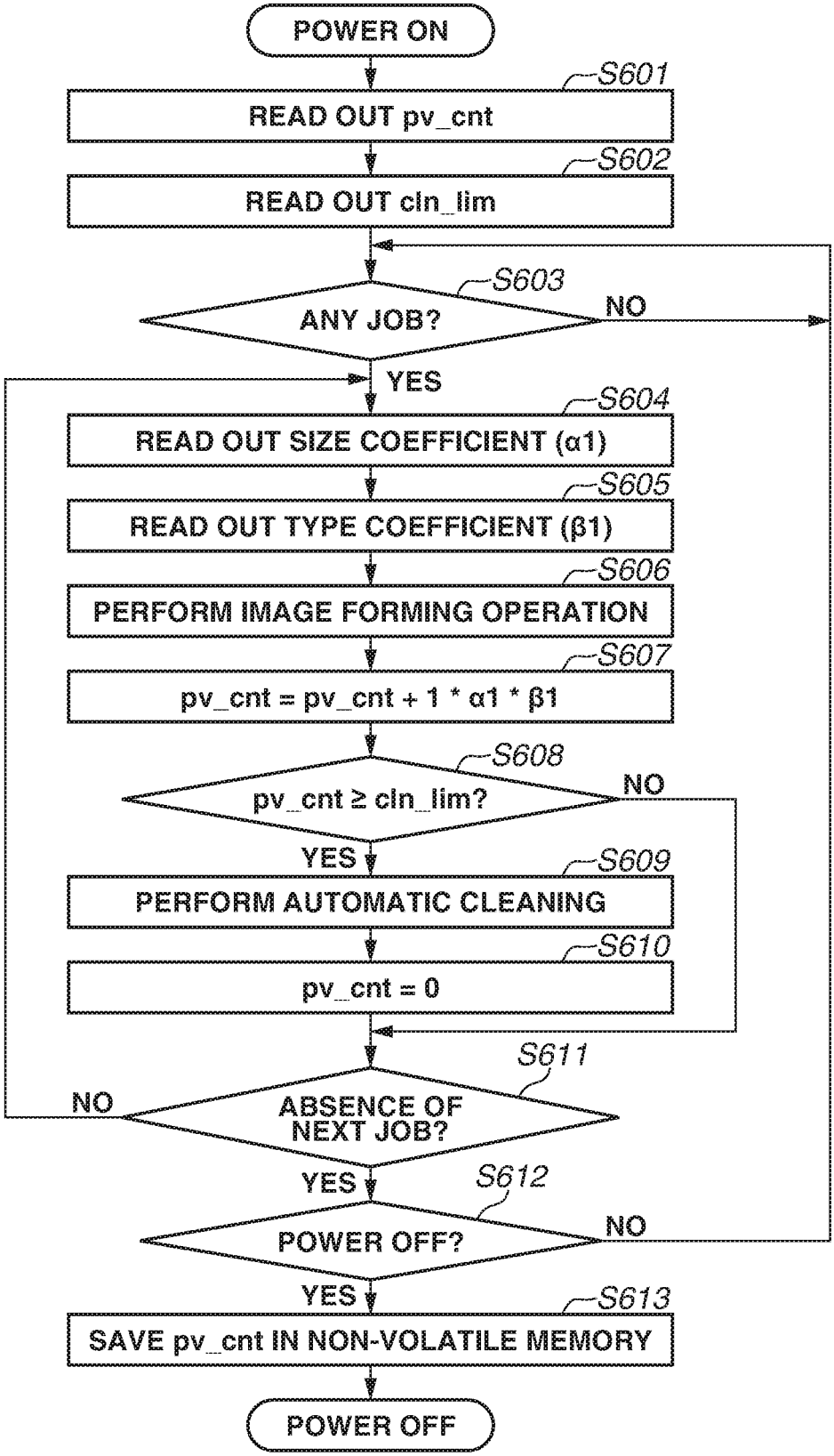
FIG. 8 is a flowchart illustrating a cleaning flow in a first exemplary embodiment.

FIG. 8 is a flowchart illustrating the flow of a cleaning operation in a first exemplary embodiment. First, in step S601, the engine control unit 74 reads out a count value (=pv_cnt) obtained after the previous execution of cleaning from the ROM 500, and then in step S602, the engine control unit 74 reads out a threshold value (=cln_lim) from the ROM 500.

Then, in step S603, the engine control unit 74 checks whether there is an image forming job, and, if it is determined that there is an image forming job (YES in step S603), the engine control unit 74 advances the processing to step S604, and, if it is determined that there is no image forming job (NO in step S603), the engine control unit 74 repeats step S603.

Here, examples of an image forming job are described. Examples of an image forming job include a copy job, a print job, and a facsimile (FAX) job.

The copy job is a job which performs an image forming operation based on image data acquired by the document reading device 305. The print job is a job which performs an image forming operation based on print data described in, for example, page-description language (PDL) received from an external apparatus, such as a personal computer (PC). Moreover, the FAX job is a job which performs an image forming operation based on facsimile data received from an FAX transmitter.

If, in step S603, it is determined that there is an image forming job (YES in step S603), then in step S604, the engine control unit 74 reads out a size coefficient (=α1, an example of a coefficient) registered via the display unit 307. Here, examples of size coefficients α1 in the present exemplary embodiment are described with reference to FIG. 10A. FIG. 10A illustrates examples of size coefficients α1 corresponding to typical sheet sizes which are used for general multifunction peripherals. Furthermore, the range of dimension errors in the present exemplary embodiment illustrated in FIG. 10A is ±0.7 mm for lengths and widths. Moreover, the size coefficient α1 which is set for recording sheets of A4 size is also set for recording sheets of Letter size (11 inches×8.5 inches, also called US Letter size).

Recording sheets are stored in the sheet feeding cassette 2, which is located at a lower portion of the image forming apparatus 1. Inside the sheet feeding cassette 2, a regulation plate (not illustrated), which prevents the stored recording sheets from moving in the sheet feeding cassette 2, is provided. The operator, such as the user or service engineer, moves the regulation plate in conformity with the size of recording sheets and then fixes the regulation plate to the sheet feeding cassette 2 with the regulation plate kept in contact with the recording sheets. With this, the recording sheets are prevented from moving in the sheet feeding cassette 2. In other words, the fixed position of the regulation plate relative to the sheet feeding cassette 2 corresponds to the size of recording sheets stored in the sheet feeding cassette 2. Therefore, for example, the IC controller 73 is able to acquire size information about recording sheets stored in the sheet feeding cassette 2 based on information about the fixed position of the regulation plate without the operator having to set the size information via the display unit 307.

In FIG. 10A, the magnitude relationship of the amounts of generation of paper dust obtained as a result of relative comparison between respective sheet sizes is illustrated as a rough indication of three levels (much, medium, and a little). In the present exemplary embodiment, the size coefficient α1 is changed according to the area ratio of a sheet of each size to a sheet of A4 size. Furthermore, the size coefficient α1 has a value serving as a baseline, as the size coefficient α1 (=1.00) of the A4 size sheet in the present exemplary embodiment. However, the size coefficient α1 can be optionally determined without having a value serving as a baseline, and weighting to the size coefficient α1 can be changed according to the size of each sheet instead of the area ratio.

As the size of a recording sheet is larger, the time required for the recording sheet to pass through a conveyance portion in the image forming apparatus 1 becomes longer. Thus, the number of contact regions per one page of recording sheet with respect to the conveyance portion becomes larger. Even with regard to one page of the same type of recording sheet, as the size of recording sheet is larger, the number of contact regions with respect to the conveyance portion is larger, so that the amount of generation of paper dust becomes larger. Furthermore, the sheet type as mentioned herein is the type of sheet determined by the presence or absence of a coating on the sheet surface and the content rate of wood pulp or waste paper pulp. Although details are described below, in the present exemplary embodiment, sheets with a waste paper pulp content rate of 70% or more are defined as recycled paper, and sheets with a waste paper pulp content rate of less than 70% are defined as plain paper. If recording sheets are the same in the presence or absence of a surface coating and are the same in the definition of the type of sheet (for example, plain paper or recycled paper), these recording sheets can be mentioned to be the same in sheet type.

With regard to recording sheets the values of grammage of which are within a predetermined range described below and which are the same in sheet type, as the sheet size is larger, the amount of generation of paper dust tends to be larger. For example, in a case where image formation for the same number of pages is performed on plain paper of B5 size and plain paper of A4 size, the amount of paper dust generated in a case where image formation is performed on plain paper of A4 size is larger than that in a case where image formation is performed on plain paper of B5 size. This tendency is the same in not only plain paper but also, for example, recycled paper or processed paper. Therefore, the number of pages image-formed for recording sheets in a period between cleaning operations from when a cleaning operation is performed to when a next cleaning operation is performed should be set smaller in a case where image formation is performed on plain paper of A4 size than in a case where image formation is performed on plain paper of B5 size. This is because, as mentioned above, the amount of paper dust which is generated when an image forming operation is performed is larger in the case of plain paper of A4 size than in the case of plain paper of B5 size. In other words, the number of pages on which image formation is allowed to be performed for only recording sheets of a predetermined type, of a predetermined grammage, and of a predetermined size or more after the cleaning mechanism performs a cleaning operation should be set smaller than the number of pages on which image formation is allowed to be performed for only recording sheets of the predetermined type, of the predetermined grammage, and of less than the predetermined size after the cleaning mechanism performs a cleaning operation. Specifically, the frequency at which to perform a cleaning operation should be set higher in the case of performing image formation on plain paper of A4 size than in the case of performing image formation on plain paper of B5 size. Here, "the number of pages on which image formation is allowed to be performed" is equivalent to the allowable number of pages on which image formation is allowed to be performed for recording sheets (an example of a predetermined condition). With regard to the predetermined size, the operator is allowed to set an optional value.

Registration of the sheet size of recording sheets set in the sheet feeding cassette 2 is performed by the operator via the display unit 307. The operator selects a sheet size of recording sheets set in the sheet feeding cassette 2 or the document feeding tray 300 from among a plurality of sheet sizes displayed on the display unit 307 as illustrated in FIG. 7A. The sheet size selected via the display unit 307 is registered in the image forming apparatus 1 as the size of recording sheets set in the sheet feeding cassette 2 or the document feeding tray 300.

Moreover, as mentioned above, the method of determining the size of recording sheets set in the sheet feeding cassette 2 based on position information about a regulation plate (not illustrated) provided inside the sheet feeding cassette 2 can be employed. In this case, the operator does not need to set the size of recording sheets via the display unit 307. When the operator sets recording sheets in the sheet feeding cassette 2, for example, the IC controller 73 determines the size of the recording sheets based on the position of the regulation plate determined in position with respect to the sheet feeding cassette 2.

Then, in step S605, the engine control unit 74 reads out a type coefficient (=β1, an example of a coefficient). Here, examples of type coefficients β1 in the present exemplary embodiment are described with reference to FIG. 10B. FIG. 10B illustrates examples of type coefficients β1 corresponding to typical types of recording sheets which are used for general multifunction peripherals. Moreover, in FIG. 10B, the magnitude relationship of the amounts of generation of paper dust obtained as a result of relative comparison between respective types of recording sheets is illustrated as a rough indication of four levels (much, medium, a little, and an extremely little). In the present exemplary embodiment, the type coefficient 131 is changed according to the respective types of recording sheets based on plain paper, which is one type of recording sheet. Furthermore, the type coefficient β1 has a value serving as a baseline, as the type coefficient β1 (=1.00) of plain paper in the present exemplary embodiment. However, the type coefficient β1 can be optionally determined for each sheet type without having a value serving as a baseline.

Here, with regard to types of recording sheets illustrated in FIG. 10B, an example of a method of classification of the types of recording sheets is described. The classification of the types of recording sheets is a classification by, for example, the grammage and material of a recording sheet and the presence or absence of surface treatment (coating). For example, "thin paper", "plain paper", and "heavy paper" illustrated in FIG. 10B are the same in sheet type but differ in the value of what is called grammage, which is expressed in grams (g) per square meter (g/m$^2$). As illustrated in FIG. 10B, the ranges of values of grammage respectively corresponding to "thin paper", "plain paper", and "heavy paper" are predetermined. In the present exemplary embodiment, a predetermined range of greater than or equal to 52 g/m$^2$ and less than 60 g/m$^2$ is set for "thin paper", a predetermined range of greater than or equal to 60 g/m$^2$ and less than 106 g/m$^2$ is set for "plain paper", and a predetermined range of greater than or equal to 106 g/m$^2$ and less than 221 g/m$^2$ is set for "heavy paper".

Both "wood pulp" and "waste paper pulp" are mainly used as materials of such three types of recording sheets. Wood pulp is made by boiling chips obtained by chipping wood together with chemicals such as caustic soda and deinking agent and thus extracting fibers from wood. Various types of pulp associated with use applications are produced by varying the compounding ratio of softwood or hardwood serving as a wood material. On the other hand, waste paper pulp is produced by removing ink or mote in waste paper. Most recording sheets, including the above-mentioned three types of recording sheets, "thin paper", "plain paper", and "heavy paper", are made by compounding both "wood pulp" and "waste paper pulp". Usually, when the content rate of "waste paper pulp" accounts for 70% (an example of a predetermined value of waste paper pulp content rate) or more of materials configuring a recording sheet, the recording sheet is called "recycled paper". Furthermore, the waste paper pulp content rate as mentioned herein is, for example, the weight percent of waste paper pulp in pulp included in the target recording sheet, and is expressed by "waste paper pulp/(wood pulp+waste paper pulp)×100%". The moisture content of pulp in this case is assumed to be 10%. However, even if "waste paper pulp" is only slightly included in materials configuring a recording sheet, the recording sheet can also be called "recycled paper". Usually, when selling recording sheets named as "recycled paper", in many cases, paper manufacturers attach thereto an indication of the content rate of waste paper pulp which is guaranteed at a minimum. The present exemplary embodiment is applicable to a recording sheet the indicated waste paper pulp content rate of which is less than a predetermined value (for example, 70%). Hereinafter, the term "recycled paper" is assumed to refer to a recording sheet the waste paper pulp content rate of which is greater than or equal to a predetermined value (for example, 70%). On the other hand, other types of paper are assumed to refer to recording sheets the waste paper pulp content rate of which is less than the predetermined value (for example, 70%). In this way, whether a recording sheet is recycled paper is defined according to whether the waste paper pulp content rate thereof is greater than or equal to a predetermined value or less than the predetermined value. Moreover, with regard to the predetermined value, the operator is allowed to set an optional value.

Assuming that recording sheets are the same in sheet type, the value of grammage becomes larger in the order of "thin paper", "plain paper", and "heavy paper". Usually, in a case where recording sheets are the same in size and type, as the value of grammage is larger, the thickness of each sheet is larger. Since, as the thickness of each sheet is larger, a pressure acting on the sheet during conveyance thereof becomes larger, the amount of paper dust generated at that time also becomes larger. Therefore, in the case of plain paper or thin paper of a predetermined size (for example, A4 size), as the grammage of the paper is larger, the amount of generation of paper dust tends to become larger. Therefore, the allowable number of pages on which image formation is allowed to be performed for recording sheets (an example of a predetermined condition) in a period from when a cleaning operation is performed to when a next cleaning operation is performed should be set smaller in a case where image formation is performed on only heavy paper than in a case where image formation is performed on only thin paper. This is because, as mentioned above, the amount of paper dust generated during image formation is larger in the case of heavy paper than in the case of thin paper. In other words, the frequency at which to perform a cleaning operation should be set higher in the case of performing image formation on heavy paper than in the case of performing image formation on thin paper.

In this way, the number of pages on which image formation is allowed to be performed for only recording sheets of a predetermined size and, for example, of a grammage greater than or equal to a predetermined grammage 60 g/m$^2$ after the cleaning mechanism performs a cleaning operation is set smaller than the number of pages on which image formation is allowed to be performed for only recording sheets of the predetermined size and, for example, of a grammage less than the predetermined grammage 60 g/m$^2$ after the cleaning mechanism performs a cleaning operation. In other words, the number of pages on which image formation is allowed to be performed for only recording sheets is smaller in the case of using plain paper or heavy paper of a grammage greater than or equal to a predetermined grammage 60 g/m$^2$ than in the case of using thin paper of a grammage less than the predetermined grammage 60 g/m$^2$. While, here, 60 g/m$^2$ is taken as an example of a value of the predetermined grammage, naturally, the operator, such as the user or service engineer, is allowed to set an optional value as a value of the predetermined grammage.

The operator is allowed to set a value of the predetermined grammage, for example, in a screen illustrated in FIG. 7B (an example of a registration unit), which is displayed on the display unit 307. As in an example of a screen displayed on the display unit 307 illustrated in FIG. 7B, a plurality of types of recording sheets is displayed in the screen. In the image forming apparatus 1, the respective values of grammage are previously defined according to the types of recording sheets. Therefore, the operator is able to select a type corresponding to recording sheets which the operator has set in the sheet feeding cassette 2, from among types of recording sheets displayed on the display unit 307, thus setting the grammage of the recording sheets. The type of recording sheets selected by the operator via the display unit 307 is registered in the image forming apparatus 1 as the type of recording sheets set in the sheet feeding cassette 2.

Moreover, the operator can directly input, via the display unit 307, the grammage of recording sheets set in, for example, the sheet feeding cassette 2. The IC controller 73 determines whether the input value of the grammage is greater than or equal to a predetermined value of the grammage or less than the predetermined value of the grammage. Then, the allowable number of pages on which image formation is allowed to be performed for recording sheets in a period between cleaning operations is determined based on a result of such determination by the IC controller 73. Furthermore, the allowable number of pages is previously defined according to whether the value of the grammage input via the display unit 307 is greater than or equal to a predetermined grammage value or less than the predetermined grammage value.

Recycled paper is made from, as a main material, waste paper pulp produced by reprocessing waste paper, such as newspaper waste paper, cardboard waste paper, or office automation (OA) sheet waste paper. Since waste paper is reused, most paper fibers constituting paper are short and uneven. As the content rate of waste paper pulp becomes higher, such a characteristic becomes more conspicuous. Therefore, recycled paper has such a characteristic that, for example, its surface has a larger number of raised and recessed portions and the generated paper dust is more likely to adhere to the paper surface as compared with plain paper.

Here, the operator, such as the user or service engineer, is able to set whether to treat the recording sheet as recycled paper with respect to the image forming apparatus 1, while referring to, for example, the content rate of waste paper indicated on a product package by the paper manufacturer. Specifically, after setting recording sheets in the sheet feeding cassette 2, the operator sets the sheet type of the set recording sheets via the display unit 307. In the image forming apparatus 1, recording sheets the waste paper pulp content rate of which is greater than or equal to a predetermined value are previously registered as "recycled paper", and recording sheets the waste paper pulp content rate of which is less than the predetermined value are previously registered as "plain paper". A screen for prompting the operator to select whether to treat the recording sheets set in the sheet feeding cassette 2 as "recycled paper" or "plain paper" is displayed on the display unit 307. In other words, the operator is able to select, via such a screen, whether the recording sheets set in the sheet feeding cassette 2 has a waste paper pulp content rate greater than or equal to a predetermined value or has a waste paper pulp content rate less than the predetermined value. Here, if the operator selects "recycled paper", the recording sheets set in the sheet feeding cassette 2 are registered as recycled paper in the image forming apparatus 1. Accordingly, regardless of the value of the waste paper pulp content rate, the operator is able to set, by the operator's determination, whether to treat the recording sheets as recycled paper.

The allowable number of pages on which image formation is allowed to be performed for recording sheets (an example of a predetermined condition) in a period from when a cleaning operation is performed to when a next cleaning operation is performed is previously set according to whether the recording sheets are previously registered as recycled paper. The allowable number of pages is smaller in the case of performing image formation on only recording sheets registered as recycled paper in a period from when a cleaning operation is performed to when a next cleaning operation is performed than in the case of performing image formation on only recording sheets registered as plain paper in a period from when a cleaning operation is performed to when a next cleaning operation is performed.

Moreover, the operator can directly input, via the display unit 307, the waste paper pulp content rate instead of the method of selecting whether to treat the recording sheets as recycled paper. The operator inputs, via the display unit 307, the waste paper pulp content rate of recording sheets set in the sheet feeding cassette 2. Then, for example, the IC controller 73 determines whether the input waste paper pulp content rate is greater than or equal to a predetermined value or less than the predetermined value. Here, if it is determined that the input waste paper pulp content rate is greater than or equal to the predetermined value, the recording sheets set in the sheet feeding cassette 2 are registered as recycled paper.

As illustrated in FIG. 10B, although the respective values of grammage are in the same range, recycled paper tends to be larger in the amount of generation of paper dust than plain paper. In the present exemplary embodiment, as illustrated in FIG. 10B, the amount of generation of paper dust is larger in the case of recycled paper than even in the case of heavy paper. Assuming that recording sheets are the same in sheet size, as the waste paper pulp content rate is larger, the amount of generation of paper dust is larger. Therefore, even in a case where recording sheets differ in sheet size, if the waste paper pulp content rate of first recycled paper differs from the waste paper pulp content rate of second recycled paper, the amount of paper dust generated in the first recycled paper may become larger than that in the second recycled paper even when the size of the first recycled paper is smaller than the size of the second recycled paper. Accordingly, in comparison between plain paper and recycled paper of the same size, the number of pages on which image formation is allowed to be performed for recording sheets in a period between cleaning operations from when a cleaning operation is performed to when a next cleaning operation is performed should be set smaller in the case of performing image formation on recycled paper than in the case of performing image formation on plain paper. This is because, as mentioned above, in a case where recording sheets are the same in size, the amount of paper dust generated when an image forming operation is performed is larger in the case of recycled paper than in the case of plain paper. In other words, the frequency at which to perform a cleaning operation should be set higher in the case of performing image formation on recycled paper than in the case of performing image formation on plain paper.

On the other hand, as illustrated in FIG. 10B, processed paper is smaller in the amount of generation of paper dust than plain paper. Here, recording sheets which are used as printing paper can be classified into two types, non-processed paper and processed paper. These two types differ in whether the surface of the recording sheet is coated with, for example, paint. Plain paper and recycled paper, which have been described above, are classified into non-processed paper, because the recording sheet surface thereof is not coated. In the case of processed paper, the recording sheet surface thereof is made smooth by covering raised and recessed portions of the surface of non-processed paper, on which paper fibers are exposed, with fine particles of paint. Usually, as the amount of application of paint used for coating is larger, the value of smoothness becomes larger. With regard to processed paper, since paper fibers are not exposed on the surface thereof, it is possible to reduce the amount of generation of paper dust as compared with plain paper and recycled paper. Assuming that recording sheets are the same in sheet size, as the amount of application of paint is larger, the amount of generation of paper dust becomes smaller. Therefore, even in a case where recording sheets differ in sheet size, if the amount of application of paint to first processed paper differs from the amount of application of paint to second processed paper, the amount of paper dust generated in the first processed paper may become smaller than that in the second processed paper even when the size of the first processed paper is larger than the size of the second processed paper. Accordingly, in comparison between recording sheets of a predetermined size and a predetermined value of grammage, the number of pages on which image formation is allowed to be performed for recording sheets in a period between cleaning operations from when a cleaning operation is performed to when a next cleaning operation is performed (an example of a predetermined condition) should be set smaller in the case of performing image formation on recording sheets with no coating made on surfaces thereof (for example, plain paper) than in the case of performing image formation on recording sheets with a coating made on surfaces thereof (for example, processed paper). This is because, as mentioned above, in a case where recording sheets are the same in size and grammage, the amount of paper dust generated when an image forming operation is performed is larger in the case of plain paper than in the case of processed paper. In other words, the frequency at which to perform a cleaning operation should be set higher in the case of performing image formation on plain paper than in the case of performing image formation on processed paper.

The operator is allowed to set whether the recording sheets set in the sheet feeding cassette 2 are recording sheets with a coating made on surfaces thereof, for example, in a screen illustrated in FIG. 7B (an example of a registration unit), which is displayed on the display unit 307. As in an example of a screen displayed on the display unit 307 illustrated in FIG. 7B, a plurality of types of recording sheets is displayed in the screen. In the image forming apparatus 1, the number of pages on which image formation is allowed to be performed for recording sheets in a period between cleaning operations are previously defined according to the types of recording sheets. The type of recording sheets selected by the operator via the display unit 307 is registered in the image forming apparatus 1 as the type of recording sheets set in the sheet feeding cassette 2. In a screen for selecting "processed paper" or "plain paper" on the display unit 307, for example, if the operator selects "processed paper", the recording sheets set in the sheet feeding cassette 2 are registered as "processed paper" in the image forming apparatus 1.

In consideration of, for example, the grammage and material of each recording sheet and the presence or absence of surface treatment (coating) as mentioned above, type coefficients corresponding to types of recording sheets are experimentally determined. Alternatively, the user or service engineer optionally sets or selects type coefficients corresponding to types of recording sheets.

Next, an image forming operation in step S606 is described. In step S606, the engine control unit 74 performs an image forming operation. After the image forming operation is performed, then in step S607, the engine control unit 74 receives a count signal 81 from the image formation control unit 84 and adds, to the count value, a value obtained by multiplying three values, i.e., a reference value determined for one page of a given type of recording sheet, the size coefficient $\alpha 1$, and the type coefficient $\beta 1$, together. In this way, the count value for each page of the image-formed recording sheet is added to the count value each time image formation is performed on one page of recording sheet, thus being progressively accumulated. Furthermore, coefficients to be multiplied by the reference value do not need to both the size coefficient $\alpha 1$ and the type coefficient $\beta 1$. For example, without consideration for the type coefficient $\beta 1$, only the size coefficient $\alpha 1$ can be multiplied by the reference value to calculate the count value. Naturally, without consideration for the size coefficient $\alpha 1$, only the type coefficient $\beta 1$ can also be multiplied by the reference value to calculate the count value.

Moreover, without using the reference value, respective values can be previously set for every sheet size or for every sheet type and such values can be used to calculate the count value. For example, when image formation has been performed on one page of plain paper of A3 size, not a value obtained by multiplying the reference value of 1.00 by the size coefficient of 1.80 but a value of 1.80 previously set for "A3 size" is counted. Similarly, for example, when image formation has been performed on one page of heavy paper of A4 size, not a value obtained by multiplying the reference value of 1.00 by the type coefficient of 1.70 but a value of 1.70 previously set for "heavy paper" is counted. This eliminates the need to perform multiplication of the reference value and facilitates calculation of the count value.

Moreover, combinations of sheet sizes and sheet types can be listed and values can be retained for the respective combinations. For example, in a case where image formation is performed on one page of "heavy paper of A3 size", in step S607, the engine control unit 74 performs calculation of "1.00×1.80×1.70 (=3.06)", thus calculating the count value. However, in such a case, a value of "3.06" can be previously listed as a value corresponding to "heavy paper of A3 size" and can be retained in the RAM 501. In this way, in calculating a count value corresponding to heavy paper of A3 size, it becomes unnecessary to perform a calculation which multiplies three different values together. Naturally, a value corresponding to a recording sheet of a given size and type does not necessarily need to be a value of "size coefficient $\alpha 1$×type coefficient $\beta 1$ of the recording sheet". With regard to, for example, "heavy paper of A3 size", a value corresponding to "heavy paper of A3 size" does not need to be 3.06, but can be an optional value experimentally obtained, such as 2.50 or 3.50.

In step S608, the engine control unit 74 makes a comparison between the threshold value previously stored in the RAM 501 and the count value, and, if it is determined that the count value has become greater than or equal to the threshold value (YES in step S608), then in step S609, the engine control unit 74 causes the cleaning control unit 75 to perform a cleaning operation, and then in step S610, the engine control unit 74 resets the count value to 0. Furthermore, in the present exemplary embodiment, the count value which has been reset is 0, but can be 1 or 10 and is not limited. As mentioned above, in a case where the operator has selected a type of recording sheet via the display unit 307, a value corresponding to such a type is registered as a threshold value. In other words, the number of pages on which image formation is allowed to be performed for recording sheets in a period between cleaning operations is determined according to a type of recording sheet registered via a registration unit.

On the other hand, if it is determined that the count value is less than the threshold value (NO in step S608), the engine control unit 74 advances the processing to step S611 for checking whether there is an image forming job to be next performed.

Furthermore, in a case where the count value has become greater than or equal to the threshold value, the engine control unit 74 can cause a "cleaning mode" mark and a "non-cleaning mode" mark to be displayed on, for example, the display unit 307 of the operation unit 304 and can prompt the operator to select whether to perform cleaning. If "cleaning mode" is selected by the operator, the engine control unit 74 advances the processing to step S609. On the other hand, if "non-cleaning mode" is selected by the operator, the engine control unit 74 skips step S609 provided for a cleaning operation and then advances the processing to step S610. Thus, if "non-cleaning mode" is selected by the operator, without causing a cleaning operation to be performed, the engine control unit 74 resets the count value to 0 in step S610.

In step S611, the engine control unit 74 checks whether there is a next image forming job. If it is determined that there is a next image forming job (NO in step S611), the engine control unit 74 returns the processing to step S604, thus continuing the above-described flow. If it is determined that there is no next image forming job (YES in step S611), then in step S612, the engine control unit 74 determines whether to power off the image forming apparatus 1.

If it is determined not to power off the image forming apparatus 1 (NO in step S612), the engine control unit 74 returns the processing to step S603, thus continuing the above-described flow. If it is determined to power off the image forming apparatus 1 (YES in step S612), then in step S613, the engine control unit 74 saves and stores the current count value (pv_cnt) counted thereby in the ROM 500 or the RAM 501, and then ends the present cleaning flow.

Taken together, in the image forming apparatus according to the present exemplary embodiment, the number of pages on which image formation is allowed to be performed for recording sheets in a period from when a cleaning operation is performed to when a next cleaning operation is performed differs depending on (1) the grammage, (2) the waste paper pulp content rate, (3) the presence or absence of surface coating, and (4) the sheet size of each recording sheet.

In the image forming apparatus according to the present exemplary embodiment, in a case where image formation is performed on only plain paper of A4 size after a cleaning operation is performed, image formation on 1,000 pages is allowed. On the other hand, in a case where image formation is performed on only heavy paper of A4 size after a cleaning operation is performed, image formation on 588 (=1,000/1.7) pages is allowed. Accordingly, in the image forming apparatus according to the present exemplary embodiment, while, in a case where image formation is performed on only plain paper of A4 size for 10,000 pages, the cleaning operation is automatically performed 10 times, in a case where image formation is performed on only heavy paper of A4 size for 10,000 pages, the cleaning operation is automatically performed 17 times. Thus, in the image forming apparatus according to the present exemplary embodiment, the frequency at which the cleaning operation is performed per a predetermined number of pages (for example, 10,000 pages being 10 times 1,000 pages, which is the allowable number of pages for plain paper of A4 size) is larger by 7 times (1.7 times higher) in a case where image formation is performed on only heavy paper than in a case where image formation is performed on only plain paper.

Moreover, in the image forming apparatus according to the present exemplary embodiment, in a case where image formation is performed on only plain paper of A4 size after a cleaning operation is performed, image formation on 1,000 pages is allowed. On the other hand, in a case where image formation is performed on only recycled paper of A4 size after a cleaning operation is performed, image formation on 500 (=1,000/2.0) is allowed. Furthermore, plain paper as mentioned herein means a recording sheet the waste paper pulp content rate of which is less than a predetermined value, and recycled paper as mentioned herein means a recording sheet the waste paper pulp content rate of which is greater than or equal to the predetermined value. Accordingly, in the image forming apparatus according to the present exemplary embodiment, while, in a case where image formation is performed on only plain paper of A4 size for 10,000 pages, the cleaning operation is automatically performed 10 times, in a case where image formation is performed on only recycled paper of A4 size for 10,000 pages, the cleaning operation is automatically performed 20 times. Thus, in the image forming apparatus according to the present exemplary embodiment, the frequency at which the cleaning operation is performed per a predetermined number of pages (for example, 10,000 pages being 10 times 1,000 pages, which is the allowable number of pages for plain paper of A4 size) is larger by 10 times (2.0 times higher) in a case where image formation is performed on only recycled paper than in a case where image formation is performed on only plain paper.

Moreover, in the image forming apparatus according to the present exemplary embodiment, in a case where image formation is performed on only plain paper of A4 size after a cleaning operation is performed, image formation on 1,000 pages is allowed. On the other hand, in a case where image formation is performed on only processed paper of A4 size after a cleaning operation is performed, image formation on 2,857 (=1,000/0.35) is allowed. Furthermore, plain paper as mentioned herein means a recording sheet with no coating made on a surface thereof, and processed paper as mentioned herein means a recording sheet with a coating made on a surface thereof. Accordingly, in the image forming apparatus according to the present exemplary embodiment, while, in a case where image formation is performed on only plain paper of A4 size for 10,000 pages, the cleaning operation is automatically performed 10 times, in a case where image formation is performed on only processed paper of A4 size for 10,000 pages, the cleaning operation is automatically performed 3 times. Thus, in the image forming apparatus according to the present exemplary embodiment, the frequency at which the cleaning operation is performed per a predetermined number of pages (for example, 10,000 pages being 10 times 1,000 pages, which is the allowable number of pages for plain paper of A4 size) is smaller by 7 times (0.35 times higher) in a case where image formation is performed on only processed paper than in a case where image formation is performed on only plain paper. In other words, the frequency of a cleaning operation is higher in the case of performing image formation on only plain paper than in the case of performing image formation on only processed paper.

Moreover, in the image forming apparatus according to the present exemplary embodiment, in a case where image formation is performed on only plain paper of A4 size after a cleaning operation is performed, image formation on 1,000 pages is allowed. On the other hand, in a case where image formation is performed on only thin paper of A4 size after a cleaning operation is performed, image formation on 2,000 (=1,000/0.50) is allowed. Accordingly, in the image forming apparatus according to the present exemplary embodiment, while, in a case where image formation is performed on only plain paper of A4 size for 10,000 pages, the cleaning operation is automatically performed 10 times, in a case where image formation is performed on only thin paper of A4 size for 10,000 pages, the cleaning operation is automatically performed 5 times. Thus, in the image forming apparatus according to the present exemplary embodiment, the frequency at which the cleaning operation is performed per a predetermined number of pages (for example, 10,000 pages being 10 times 1,000 pages, which is the allowable number of pages for plain paper of A4 size) is smaller by 5 times (0.50 times higher) in a case where image formation is performed on only thin paper than in a case where image formation is performed on only plain paper. In other words, the frequency of a cleaning operation is higher in the case of performing image formation on only plain paper than in the case of performing image formation on only thin paper.

Moreover, in the image forming apparatus according to the present exemplary embodiment, in a case where image formation is performed on only plain paper of A4 size after a cleaning operation is performed, image formation on 1,000 pages is allowed. On the other hand, in a case where image formation is performed on only plain paper of A3 size after a cleaning operation is performed, image formation on 556 (=1,000/1.80) is allowed. Furthermore, plain paper of A4 size and plain paper of A3 size as mentioned herein differ only in sheet size and are the same in, for example, grammage and material thereof. Accordingly, in the image forming apparatus according to the present exemplary embodiment, while, in a case where image formation is performed on only plain paper of A4 size for 10,000 pages, the cleaning operation is automatically performed 10 times, in a case where image formation is performed on only plain paper of A3 size for 10,000 pages, the cleaning operation is automatically performed 17 times. Thus, in the image forming apparatus according to the present exemplary embodiment, the frequency at which the cleaning operation is performed per a predetermined number of pages (for example, 10,000 pages being 10 times 1,000 pages, which is the allowable number of pages for plain paper of A4 size) is larger by 7 times (1.80 times higher) in a case where image formation is performed on only plain paper of A3 size than in a case where image formation is performed on only plain paper of A4 size.

Moreover, the present exemplary embodiment is applicable to a case where image formation has been performed on two or more different types of recording sheets (for example, plain paper and recycled paper) in a period between cleaning operations. For example, in a case where image formation is performed on only plain paper of A4 size after a cleaning operation is performed, image formation on 1,000 pages is allowed. On the other hand, in a case where image formation is performed on plain paper of A4 size and heavy paper of A4 size after a cleaning operation is performed, the number of pages on which image formation is allowed to be performed is less than 1,000. For example, in response to image formation having been performed on 500 pages of plain paper and image formation further having been performed on 294 pages of heavy paper, a next cleaning operation is performed. Accordingly, in the image forming apparatus according to the present exemplary embodiment, while, in a case where image formation is performed on only plain paper of A4 size for 10,000 pages, the cleaning operation is automatically performed 10 times, in a case where image formation is performed on only plain paper of A4 size for 5,000 pages and image formation is further performed on only heavy paper of A4 size for 5,000 pages, the cleaning operation is automatically performed 13 times (the cleaning operation for plain paper: 5 times, the cleaning operation for heavy paper: 8 times). Thus, in the image forming apparatus according to the present exemplary embodiment, the frequency at which the cleaning operation is performed per a predetermined number of pages (for example, 10,000 pages being 10 times 1,000 pages, which is the allowable number of pages for plain paper of A4 size) is larger by 3 times in a case where image formation is performed on only plain paper and heavy paper than in a case where image formation is performed on only plain paper.

As described above, it is possible to adjust timing at which to perform a cleaning operation according to types of recording sheets, such as the sheet size or sheet type. With this, even in an environment in which recording sheets which are likely to cause paper dust to be generated in the image forming apparatus 1 are used, it is possible to prevent or reduce a decrease in image quality due to paper dust remaining on the transparent member.

Next, a second exemplary embodiment is described. The second exemplary embodiment is configured to subtract a value obtained by multiplying coefficients corresponding to the size of a recording sheet and the type of a recording sheet together from the count value (pv_cnt). Furthermore, similar portions to those in the configuration of the first exemplary embodiment are omitted from description here.

Figure 9:
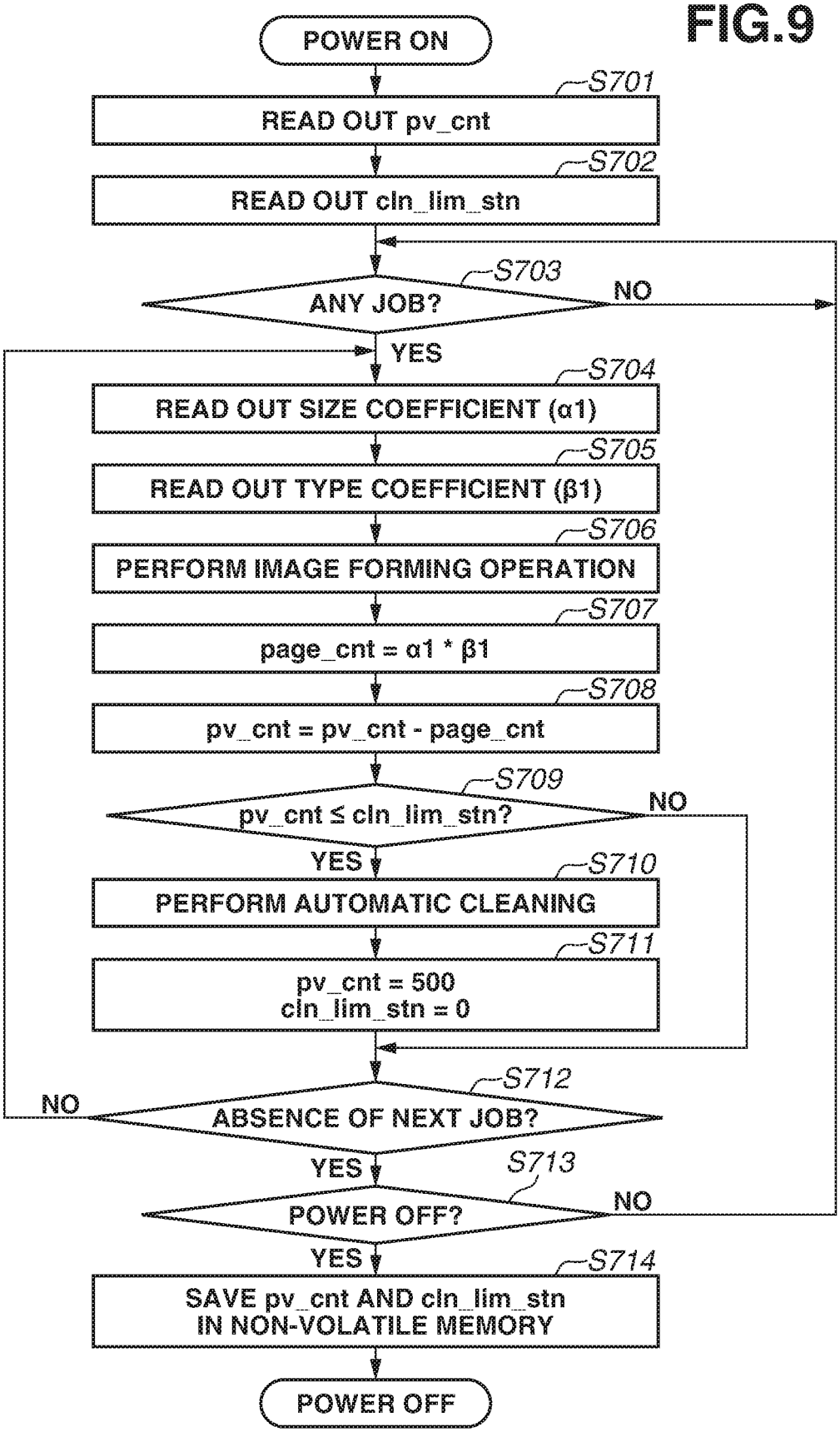
FIG. 9 is a flowchart illustrating a cleaning flow in a second exemplary embodiment.

Control performed by the engine control unit 74 in a cleaning operation according to the second exemplary embodiment is described with reference to the flowchart of FIG. 9.

First, in step S701, the engine control unit 74 reads out a count value (=pv_cnt) obtained after the previous cleaning operation is performed from the ROM 500. Next, in step S702, the engine control unit 74 reads out a standard value (=cln_lim_stn) for performing a cleaning operation from the ROM 500. The standard value can be not a value stored in the ROM 500 but a value retained as a fixed parameter for calculation. Furthermore, in the second exemplary embodiment, the standard value is assumed to be 0.

Then, in step S703, the engine control unit 74 checks whether there is an image forming job, and, if it is determined that there is an image forming job (YES in step S703), the engine control unit 74 advances the processing to step S704, and, if it is determined that there is no image forming job (NO in step S703), the engine control unit 74 repeats step S703.

If it is determined that there is an image forming job (YES in step S703), then in step S704, the engine control unit 74 reads out a size coefficient (=al, an example of a coefficient) from the display unit 307.

Then, in step S705, the engine control unit 74 reads out a type coefficient (=(31, an example of a coefficient).

Next, in step S706, the engine control unit 74 performs an image forming operation. After the image forming operation is performed, then in step S707, the engine control unit 74 receives a count signal 81 from the image formation control unit 84 and calculates a count value (page_cnt). Here, in calculating the count value (page_cnt), the engine control unit 74 does not necessarily need to use both the size coefficient α1 and the type coefficient β1. For simpler processing, the engine control unit 74 can calculate the count value with use of only the size coefficient al, or can calculate the count value with use of only the type coefficient β1. Moreover, the engine control unit 74 can calculate the count value with use of a value serving as the reference value as mentioned in the first exemplary embodiment. Thus, in calculating the count value (page_cnt) in step S708, the engine control unit 74 can multiply the reference value by the size coefficient α1 and the type coefficient β1.

Next, in step S708, the engine control unit 74 calculates a value obtained by subtracting the count value (page_cnt) from the count value (pv_cnt), as a new count value (pv_cnt).

In step S709, the engine control unit 74 makes a comparison between the count value (pv_cnt) previously stored in the RAM 501 and the standard value (=cln_lim_stn), and, if it is determined that the count value (pv_cnt) has become less than or equal to the standard value (=cln_lim_stn) (YES in step S709), then in step S710, the engine control unit 74 causes the cleaning control unit 75 to perform a cleaning operation, and then in step S711, the engine control unit 74 resets the count value to 500.

Furthermore, in a case where the count value (pv_cnt) has become less than or equal to the standard value (=cln_lim_stn), the engine control unit 74 can cause a "cleaning mode" mark and a "non-cleaning mode" mark to be displayed on, for example, the display unit 307 of the operation unit 304 and can prompt the operator to select whether to perform cleaning. If "cleaning mode" is selected by the operator, the engine control unit 74 advances the processing to step S710. On the other hand, if "non-cleaning mode" is selected by the operator, the engine control unit 74 skips step S710 provided for a cleaning operation and then advances the processing to step S711. Thus, if "non-cleaning mode" is selected by the operator, without causing a cleaning operation to be performed, the engine control unit 74 resets the count value (pv_cnt) to 500 in step S711.

Furthermore, in the present exemplary embodiment, the count value (pv_cnt) is reset to 500 as an initial value. However, the initial value of the count value (pv_cnt) is not limited to 500, but can be, for example, 1,000 or 1,500. The standard value can also be a value which is allowed to be optionally set by the operator, such as 1 or 10. If it is determined that the count value (pv_cnt) is greater than the standard value (NO in step S709), the engine control unit 74 advances the processing to step S712 for checking whether there is an image forming job to be next performed.

In step S712, the engine control unit 74 checks whether there is a next image forming job. If it is determined that there is a next image forming job (NO in step S712), the engine control unit 74 returns the processing to step S704, thus continuing the above-described flow. If it is determined that there is no next image forming job (YES in step S712), then in step S713, the engine control unit 74 determines whether to power off the image forming apparatus 1.

If it is determined not to power off the image forming apparatus 1 (NO in step S713), the engine control unit 74 returns the processing to step S703, thus continuing the above-described flow. If it is determined to power off the image forming apparatus 1 (YES in step S713), then in step S714, the engine control unit 74 saves and stores the current count value (pv_cnt) counted thereby and the standard value in the ROM 500 or the RAM 501, and then ends the cleaning operation in the flowchart of FIG. 9.

As described above, the present exemplary embodiment is able to adjust the number of pages on which image formation is performed for recording sheets in a period between cleaning operations according to the sheet size or sheet type. With this, even in a case where image formation is performed on recording sheets in which the amount of generation of paper dust is large, it is possible to prevent or reduce a decrease in image quality due to paper dust remaining on the transparent members. On the other hand, in a case where image formation is performed on recording sheets in which the amount of generation of paper dust is small, the period between cleaning operations is widened, so that it is possible to prevent or reduce a decrease in productivity.

While, in the above-described exemplary embodiments, a configuration in which the optical scanning device 40 is located below the image forming units 10 as viewed in the vertical direction has been described, a configuration in which the optical scanning device 40 is located above the image forming units 10 as viewed in the vertical direction can be employed. In the case of this configuration, since the transparent members 42*a* to 42*d* are provided above the image forming units 10, for example, toner or paper dust does not fall from the image forming units 10 to the transparent members 42*a* to 42*d*. However, since flying toner or paper dust may adhere to the transparent members 42*a* to 42*d*, the cleaning mechanism 51 needs to be provided, so that the present disclosure can also be applied to such a configuration.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-169614 filed Sep. 11, 2018, which is hereby incorporated by reference herein in its entirety.

What is claimed is:

1. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window; and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs the next cleaning operation on the transparent window, and wherein the allowable number of pages, in a case where image formation is performed on only recording sheets of a predetermined size and of greater than or equal to a predetermined grammage after the cleaning mechanism performs the cleaning operation, is smaller than the allowable number of pages in a case where image formation is performed on only recording sheets of the predetermined size and of less than the predetermined grammage after the cleaning mechanism performs the cleaning operation.

2. The image forming apparatus according to claim 1, further comprising:

a sheet feeding unit configured to feed recording sheets; and a registration unit configured to allow an operator to select whether to treat recording sheets set in the sheet feeding unit as recording sheets of greater than or equal to the predetermined grammage or recording sheets of less than the predetermined grammage, and to register the recording sheets set in the sheet feeding unit as recording sheets of greater than or equal to the predetermined grammage or recording sheets of less than the predetermined grammage in the image forming apparatus, wherein the allowable number of pages, in a case where image formation is performed on only recording sheets registered by the registration unit as recording sheets of greater than or equal to the predetermined grammage, is smaller than the allowable number of pages in a case where image formation is performed on only recording sheets registered by the registration unit as recording sheets of less than the predetermined grammage.

3. The image forming apparatus according to claim 1, further comprising:

a sheet feeding unit configured to feed recording sheets; and a registration unit configured to allow an operator to register a grammage of recording sheets set in the sheet feeding unit in the image forming apparatus, wherein the allowable number of pages is previously defined according to whether the grammage registered by the registration unit is greater than or equal to the predetermined grammage or less than the predetermined grammage, and the allowable number of pages is smaller in a case where image formation is performed on only recording sheets registered by the registration unit as recording sheets of greater than or equal to the predetermined grammage than in a case where image formation is performed on only recording sheets registered by the registration unit as recording sheets of less than the predetermined grammage.

4. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window; and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs a next cleaning operation on the transparent window, and wherein the allowable number of pages, in a case where image formation is performed on only recording sheets of a predetermined size and of a waste paper pulp content rate greater than or equal to a predetermined value after the cleaning mechanism performs the cleaning operation, is smaller than the allowable number of pages in a case where image formation is performed on only recording sheets of the predetermined size and of a waste paper pulp content rate less than the predetermined value after the cleaning mechanism performs the cleaning operation.

5. The image forming apparatus according to claim 4, further comprising:

a sheet feeding unit configured to feed recording sheets; and a registration unit configured to allow an operator to select whether to treat recording sheets set in the sheet feeding unit as recording sheets of a waste paper pulp content rate greater than or equal to the predetermined value or recording sheets of a waste paper pulp content rate less than the predetermined value, and to register the recording sheets set in the sheet feeding unit as recording sheets of a waste paper pulp content rate greater than or equal to the predetermined value or recording sheets of a waste paper pulp content rate less than the predetermined value in the image forming apparatus, wherein the allowable number of pages, in a case where image formation is performed on only recording sheets registered by the registration unit as recording sheets of a waste paper pulp content rate greater than or equal to the predetermined value, is smaller than the allowable number of pages in a case where image formation is performed on only recording sheets registered by the registration unit as recording sheets of a waste paper pulp content rate less than the predetermined value.

6. The image forming apparatus according to claim 4, further comprising:

a sheet feeding unit configured to feed recording sheets; and a registration unit configured to allow an operator to register a waste paper pulp content rate of recording sheets set in the sheet feeding unit in the image forming apparatus, wherein the allowable number of pages is previously defined according to whether the waste paper pulp content rate registered by the registration unit is greater than or equal to the predetermined value or less than the predetermined value, and the allowable number of pages is smaller in a case where image formation is performed on only recording sheets of the waste paper pulp content rate registered by the registration unit greater than or equal to the predetermined value than in a case where image formation is performed on only recording sheets of the waste paper pulp content rate registered by the registration unit less than the predetermined value.

7. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window; and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs the next cleaning operation for the transparent window, and wherein the allowable number of pages, in a case where image formation is performed on only recording sheets of a predetermined size and with no coating made on surfaces thereof after the cleaning mechanism performs the cleaning operation, is smaller than the allowable number of pages in a case where image formation is performed on only recording sheets of the predetermined size and with a coating made on surfaces thereof after the cleaning mechanism performs the cleaning operation.

8. The image forming apparatus according to claim 7, further comprising:

a sheet feeding unit configured to feed recording sheets; and a registration unit configured to allow an operator to select whether to treat recording sheets set in the sheet feeding unit as recording sheets with no coating made on surfaces thereof or recording sheets with a coating made on surfaces thereof, and to register the recording sheets set in the sheet feeding unit as recording sheets with no coating made on surfaces thereof or recording sheets with a coating made on surfaces thereof in the image forming apparatus, wherein the allowable number of pages, in a case where image formation is performed on only recording sheets registered by the registration unit as recording sheets with no coating made on surfaces thereof, is smaller than the allowable number of pages in a case where image formation is performed on only recording sheets registered by the registration unit as recording sheets with a coating made on surfaces thereof.

9. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light with toner and transferring the image developed to the recording sheet;

a cleaning mechanism configured to clean the transparent window; and a control unit configured to cause the cleaning mechanism to perform a cleaning operation on the transparent window, the control unit causing the cleaning mechanism to perform a next cleaning operation on the transparent window in response to a number of pages of image-formed on recording sheets after the cleaning mechanism performs the cleaning operation satisfying a predetermined condition, wherein the predetermined condition is an allowable number of pages as the number of pages of recording sheets on which image formation is allowed until, after performing the cleaning operation, the cleaning mechanism performs the next cleaning operation on the transparent window, and wherein the allowable number of pages, in a case where image formation is performed on only recording sheets of a predetermined type and a predetermined grammage and of greater than or equal to a predetermined size after the cleaning mechanism performs the cleaning operation, is smaller than the allowable number of pages in a case where image formation is performed on only recording sheets of the predetermined type and the predetermined grammage and of less than the predetermined size after the cleaning mechanism performs the cleaning operation.

10. The image forming apparatus according to claim 9, further comprising:

a sheet feeding unit configured to feed recording sheets; and a registration unit configured to allow an operator to select whether to treat recording sheets set in the sheet feeding unit as recording sheets of greater than or equal to the predetermined size or recording sheets of less than the predetermined size, and to register the recording sheets set in the sheet feeding unit as recording sheets of greater than or equal to the predetermined size or recording sheets of less than the predetermined size in the image forming apparatus, wherein the allowable number of pages, in a case where image formation is performed on only recording sheets registered by the registration unit as recording sheets of greater than or equal to the predetermined size, is smaller than the allowable number of pages in a case where image formation is performed on only recording sheets registered by the registration unit as recording sheets of less than the predetermined size.

11. The image forming apparatus according to claim 9, further comprising:

a sheet feeding unit configured to feed recording sheets; and a registration unit configured to allow an operator to register a size of recording sheets set in the sheet feeding unit in the image forming apparatus, wherein the allowable number of pages is previously defined according to whether the size registered by the registration unit is greater than or equal to the predetermined size or less than the predetermined size, and the allowable number of pages is smaller in a case where image formation is performed on only recording sheets registered by the registration unit as recording sheets of greater than or equal to the predetermined size than in a case where image formation is performed on only recording sheets registered by the registration unit as recording sheets of less than the predetermined size.

12. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window;

a counter configured to, so as to count a number of pages of image-formed on recording sheets until, after performing the cleaning operation, the cleaning mechanism performs a next cleaning operation for the transparent window, count a value obtained by multiplying a reference value determined for one page of each recording sheet by a coefficient set according to whether each recording sheet is of greater than or equal to a predetermined grammage or is of less than the predetermined grammage, every time image formation on one page of each recording sheet is ended; and a control unit configured to generate a signal for a cleaning instruction to cause the cleaning mechanism to clean the transparent window in response to the value counted by the counter reaching a predefined value, wherein a value of the coefficient set for recording sheets of greater than or equal to the predetermined grammage is larger than a value of the coefficient set for recording sheets of less than the predetermined grammage, and wherein, in a case where image formation is performed for only identical numbers of pages on recording sheets of greater than or equal to the predetermined grammage and recording sheets of less than the predetermined grammage, the value counted by the counter is larger in a case where image formation is performed on recording sheets of greater than or equal to the predetermined grammage than in a case where image formation is performed on recording sheets of less than the predetermined grammage.

13. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window;

a counter configured to, so as to count a number of pages of image-formed on recording sheets until, after performing the cleaning operation, the cleaning mechanism performs a next cleaning operation on the transparent window, count a value obtained by multiplying a reference value determined for one page of each recording sheet by a coefficient set according to whether a waste paper pulp content rate of each recording sheet is greater than or equal to a predetermined value or is less than the predetermined value, every time image formation on one page of each recording sheet is ended; and a control unit configured to generate a signal for a cleaning instruction to cause the cleaning mechanism to clean the transparent window in response to the value counted by the counter reaching a predefined value, wherein a value of the coefficient set for recording sheets of a waste paper pulp content rate greater than or equal to the predetermined value is larger than a value of the coefficient set for recording sheets of a waste paper pulp content rate less than the predetermined value, and wherein, in a case where image formation is performed for only identical numbers of pages on recording sheets of a waste paper pulp content rate greater than or equal to the predetermined value and recording sheets of a waste paper pulp content rate less than the predetermined value, the value counted by the counter is larger in a case where image formation is performed on recording sheets of a waste paper pulp content rate greater than or equal to the predetermined value than in a case where image formation is performed on recording sheets of a waste paper pulp content rate less than the predetermined value.

14. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light with toner and transferring the image developed to the recording sheet;

a cleaning mechanism configured to clean the transparent window;

a counter configured to, so as to count a number of sheets of image-formed on recording sheets until, after performing the cleaning operation, the cleaning mechanism performs a next cleaning operation for the transparent window, count a value obtained by multiplying a reference value determined for one page of each recording sheet by a coefficient set according to whether each recording sheet is of a predetermined size and with a coating made on a surface thereof, every time image formation on one page of each recording sheet is ended; and a control unit configured to generate a signal for a cleaning instruction to cause the cleaning mechanism to clean the transparent window in response to the value counted by the counter reaching a predefined value, wherein a value of the coefficient set for recording sheets with no coating made on surfaces thereof is larger than a value of the coefficient set for recording sheets with a coating made on surfaces thereof, and wherein, in a case where image formation is performed for only identical numbers of pages on recording sheets with no coating made on surfaces thereof and recording sheets with a coating made on surfaces thereof, the value counted by the counter is larger in a case where image formation is performed on recording sheets with no coating made on surfaces thereof than in a case where image formation is performed on recording sheets with a coating made on surfaces thereof.

15. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window;

a counter configured to, so as to count a number of sheets of image-formed on recording sheets until, after performing the cleaning operation, the cleaning mechanism performs a next cleaning operation on the transparent window, count a value obtained by multiplying a reference value determined for one page of each recording sheet by a coefficient set according to whether each recording sheet is of a predetermined type and a predetermined grammage and of greater than or equal to a predetermined size or not, every time image formation on one page of each recording sheet is ended; and a control unit configured to generate a signal for a cleaning instruction to cause the cleaning mechanism to clean the transparent window in response to the value counted by the counter reaching a predefined value, wherein a value of the coefficient set for recording sheets of greater than or equal to the predetermined size is larger than a value of the coefficient set for recording sheets of less than the predetermined size, and wherein, in a case where image formation is performed for only identical numbers of pages on recording sheets of greater than or equal to the predetermined size and recording sheets of less than the predetermined size, the value counted by the counter is larger in a case where image formation is performed on recording sheets of greater than or equal to the predetermined size than in a case where image formation is performed on recording sheets of less than the predetermined size.

16. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window;

a counter configured to, so as to count a number of pages of image-formed on recording sheets until, after performing the cleaning operation, the cleaning mechanism performs a next cleaning operation for the transparent window, count a value set according to whether each recording sheet is of greater than or equal to a predetermined grammage or is of less than the predetermined grammage, every time image formation on one page of each recording sheet is ended; and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets of greater than or equal to the predetermined grammage and recording sheets of less than the predetermined grammage, the value counted by the counter is larger in a case where image formation is performed on recording sheets of greater than or equal to the predetermined grammage than in a case where image formation is performed on recording sheets of less than the predetermined grammage.

17. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window;

a counter configured to, so as to count a number of pages of image-formed on recording sheets until, after performing the cleaning operation, the cleaning mechanism performs a next cleaning operation for the transparent window, count a value set according to whether a waste paper pulp content rate of each recording sheet is greater than or equal to a predetermined value, every time image formation on one page of each recording sheet is ended; and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets of a waste paper pulp content rate greater than or equal to the predetermined value and recording sheets of a waste paper pulp content rate less than the predetermined value, the value counted by the counter is larger in a case where image formation is performed on recording sheets of a waste paper pulp content rate greater than or equal to the predetermined value than in a case where image formation is performed on recording sheets of a waste paper pulp content rate less than the predetermined value.

18. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window;

a counter configured to, so as to count a number of sheets of image-formed on recording sheets until, after performing the cleaning operation, the cleaning mechanism performs a next cleaning operation for the transparent window, count a value set according to whether each recording sheet is of a predetermined size and with a coating made on a surface thereof, every time image formation on one page of each recording sheet is ended; and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets with no coating made on surfaces thereof and recording sheets with a coating made on surfaces thereof, the value counted by the counter is larger in a case where image formation is performed on recording sheets with no coating made on surfaces thereof than in a case where image formation is performed on recording sheets with a coating made on surfaces thereof.

19. An image forming apparatus comprising:

a photosensitive drum;

an image forming unit including an optical scanning device having a transparent window through which laser light for scanning the photosensitive drum passes, the image forming unit being configured to form an image on a recording sheet by developing, with toner, an electrostatic latent image formed on the photosensitive drum scanned by the laser light and transferring the image developed with toner to the recording sheet;

a cleaning mechanism configured to clean the transparent window;

a counter configured to, so as to count a number of sheets of image-formed on recording sheets until, after performing the cleaning operation, the cleaning mechanism performs a next cleaning operation for the transparent window, count a value set according to whether each recording sheet is of a predetermined type and a predetermined grammage and of greater than or equal to a predetermined size or not, every time image formation on one page of each recording sheet is ended; and a control unit configured to generate a signal for a cleaning instruction to cause the cleaning mechanism to clean the transparent window in response to the value counted by the counter reaching a predefined value, wherein, in a case where image formation is performed for only identical numbers of pages on recording sheets of greater than or equal to the predetermined size and recording sheets of less than the predetermined size, the value counted by the counter is larger in a case where image formation is performed on recording sheets of greater than or equal to the predetermined size than in a case where image formation is performed on recording sheets of less than the predetermined size.

* * * * *